US006646629B2

(12) United States Patent
Furuhashi et al.

(10) Patent No.: US 6,646,629 B2
(45) **Date of Patent: *Nov. 11, 2003**

(54) LIQUID CRYSTAL DISPLAY CONTROL DEVICE, LIQUID CRYSTAL DISPLAY DEVICE USING THE SAME, AND INFORMATION PROCESSOR

(75) Inventors: Tsutomu Furuhashi, Yokohama (JP); Satoshi Konuma, Chigasaki (JP); Tatsumi Mori, Jsehara (JP); Hiroshi Kurihara, Mobara (JP); Shigeyuki Nishitani, Yokohama (JP); Masashi Mori, Fujisawa (JP); Takeshi Maeda, Yokosuka (JP)

(73) Assignees: Hitachi, Ltd., Tokyo (JP); Hitachi Video and Information Systems, Inc., Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/050,563

(22) Filed: Jan. 18, 2002

(65) Prior Publication Data

US 2002/0063675 A1 May 30, 2002

Related U.S. Application Data

(63) Continuation of application No. 09/264,872, filed on Mar. 9, 1999, now Pat. No. 6,340,970.

(30) Foreign Application Priority Data

Mar. 9, 1998 (JP) ..... 10-056684

(51) Int. Cl.[7] ..... G09G 3/36; G09G 5/00

(52) U.S. Cl. ..... 345/99; 345/87; 345/214

(58) Field of Search ..... 345/87, 90, 98–99, 345/213–214

(56) References Cited

U.S. PATENT DOCUMENTS

| | | | | |
|---|---|---|---|---|
| 5,940,136 A | * | 8/1999 | Abe et al. | 348/537 |
| 6,097,437 A | | 8/2000 | Hwang | |
| 6,340,970 B1 | * | 1/2002 | Furuhashi et al. | 345/213 |

FOREIGN PATENT DOCUMENTS

| | | |
|---|---|---|
| JP | 7-134575 | 5/1995 |
| JP | 7-160222 | 6/1995 |
| JP | 10-23359 | 1/1998 |

* cited by examiner

*Primary Examiner*—Richard Hjerpe
*Assistant Examiner*—Duc Q Dinh
(74) *Attorney, Agent, or Firm*—Antonelli, Terry, Stout & Kraus, LLP

(57) ABSTRACT

A liquid crystal display control device is provided with a clock generating circuit for generating, on the basis of a first synchronous signal, a dot clock having a predetermined period, a phase which varies on dot-period basis for every frame period of the first video signal, an input circuit for picking up the first video signal in accordance with the dot clock and outputting digital display data, a frame memory in which the digital display data are stored, and a control circuit for generating a second synchronous signal for a liquid crystal display and reading out the display data stored in the frame memory to generate a second video signal, whereby a series of operations from a pickup operation of the video signal to a display operation of the liquid crystal panel can be performed at a lower speed while suppressing deterioration in quality of display images.

15 Claims, 29 Drawing Sheets

LIQUID CRYSTAL DISPLAY CONTROL DEVICE, LIQUID CRYSTAL DISPLAY DEVICE USING THE SAME, AND INFORMATION PROCESSOR

CROSS REFERENCE TO RELATED APPLICATION

This is a continuation of U.S. application Ser. No. 09/264,872, filed Mar. 9, 1999, now U.S. Pat. No. 6,340,970, the subject matter of which is incorporated by reference herein.

BACKGROUND OF THE INVENTION

1. Field of the Invention

The present invention relates to a liquid crystal display control device which is supplied with video signals and synchronous signals to control a liquid crystal panel to display the information of the video signals thereon, and particularly to a liquid crystal display control device for controlling the display operation of video signals which are not supported by driving circuits of the liquid crystal panel.

2. Description of Related Art

As shown in FIG. 28, a general computer outputs a horizontal synchronous signal (HSYNC), a vertical synchronous signal (VSYNC) and video signals (R, G, B) to a CRT (Cathode Ray Tube) display device as a target. In the CRT display device, a scan operation on the CRT is carried out on the basis of the horizontal synchronous signal and the vertical synchronous signal thus input to display the video signals on the screen of the CRT.

There is known a liquid crystal display device to which such horizontal and vertical synchronous signals for CRT are input to display video signals thereon. As shown in FIG. 29, this type of liquid crystal display device 22 comprises a controller 22-*a* and an LCD display unit 22-*b*. The controller 22-*a* comprises an A/D converter 23, a data processing circuit 24, a PLL (Phase Locked Loop) circuit 25, an LCD display unit 26 and a buffer 27 as shown in FIG. 30.

On the basis of the horizontal synchronous signal thus input, the PLL circuit 25 generates a dot clock whose period is coincident with a 1-dot period of the video signal. The A/D converter 23 converts the video signal to video data every dot in accordance with the dot clock. The data processing circuit 24 and the LCD display unit 26 also operates while the dot clock is set as a reference operating clock therefor.

For example, Japanese Laid-open Patent Application No. Hei-7-160222 discloses a liquid crystal display device which is designed to support variation of the dot period of input video signals. In the liquid crystal display device, the PLL circuit is controlled on the basis of the value of video data picked up in accordance with the dot clock to generate a dot clock whose period is coincident with the dot period of the video signal.

SUMMARY OF THE INVENTION

In order to enhance the resolution of display images and reduce the flicker of display of a CRT display device, the speed of video signals and synchronous signals output from a computer have been increased, and it is expected that the speed of these signals will be further increased from this time on.

However, in the conventional liquid crystal display device as described above, the dot clock whose period is coincident with the dot period of the input video signal is used as a reference clock, and the A/D conversion and the data processing are carried out on the video signal on the basis of the reference clock. In order to enable input of high-speed video signals, an A/D converter and a PLL circuit which can operate at high speed and are expensive are needed. Further, the high-speed operation of internal circuits induces such a problem that radiation of high-frequency electromagnetic waves and power consumption are increased.

Therefore, an object of the present invention is to provide a liquid crystal display control device which can perform a series of operations from a pickup operation of video signals to a display driving operation of a display panel at a lower speed while suppressing quality deterioration of display images.

In order to attain the above object, according to the present invention, there is provided a liquid crystal display control device for picking up the first video signal and the first synchronous signal to generate the second video signal and the second synchronous signal with which a dot-matrix type liquid crystal panel displays images thereon, which includes a clock generating circuit for generating, on the basis of the first synchronous signal, a 1/n-frequency dot clock whose period is equal to n times the dot period of the first video signal (n represents an integer not less than 2) and whose phase is varied on a dot-period basis every frame period of the first video signal, a data input circuit for picking up the first video signal in accordance with the 1/n-frequency dot clock and outputting display data which are digital data, a frame memory in which the display data outputted are stored, and a control circuit for generating the second synchronous signal at a predetermined timing and reading out the display data of one frame stored in the frame memory in synchronism with the synchronous signal to generate the second video signal.

DETAILED DESCRIPTION OF THE PREFERRED EMBODIMENTS

Preferred embodiments according to the present invention will be described hereunder with reference to the accompanying drawings.

A liquid crystal display control device according to a first embodiment of the present invention will be described with reference to FIGS. 1 to 9.

Figure 1:
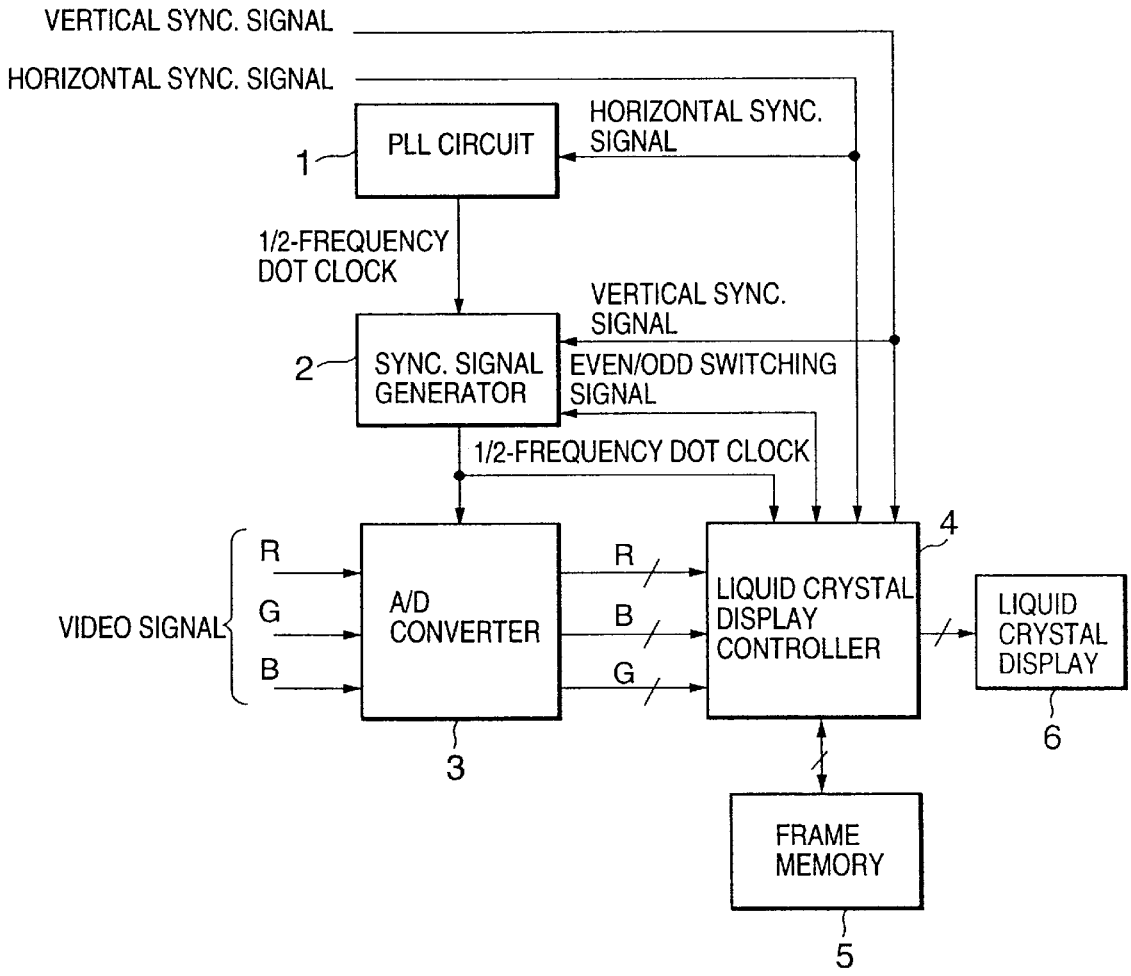
FIG. 1 is a diagram showing a liquid crystal display device according to a first embodiment of the present invention.

FIG. 1 is a block diagram showing the construction of a liquid crystal display control device according to the first embodiment of the present invention. The liquid crystal display control device includes a PLL circuit 1, a synchronous signal generating circuit 2, an A/D conversion circuit 3, a liquid crystal display controller 4 and a frame memory 5.

The liquid crystal display control device is supplied with a non-interlace synchronous signal for a CRT display device (hereinafter referred to as "input synchronous signal") and a video signal for a CRT display device (hereinafter referred to as "input video signal") through a computer such as a personal computer or a workstation, and outputs a synchronous signal for a liquid crystal display unit 6 (hereinafter referred to as "output synchronous signal") and a video signal for the liquid crystal display unit 6 (hereinafter referred to as "output video signal").

The input synchronous signal comprises a vertical synchronous signal and a horizontal synchronous signal, and the input video signal comprises three analog data signals of R(red), G(green), B(blue).

The output synchronous signal comprises a vertical synchronous signal, a horizontal synchronous signal and a dot clock. The output video signal is a digital data (display data) signal, and it is composed of plural bits for each of R, G, B. For example, for 8-color display, 1 bit is allocated for each of R, G, B, and for 64-color display, 2 bits are allocated to each of R, G, B.

The input video signal and the output video signal represent images of the same resolution (dot arrangement). The output synchronous signal is asynchronous with the input synchronous signal and has a lower speed than that of the input synchronous signal, and it varies at a predetermined timing to drive the liquid crystal display unit 6.

In this embodiment, the period of a ½-frequency dot clock serving as a reference operating clock for the liquid crystal display control device and the liquid crystal display unit 6 is equal to twice the dot period of the input video signal. Here, the dot period is defined as a switching period in which the content of the data of the input video signal (R,G,B) is switched. A set of video signal data having the same dot period are dot data indicating a display color of one dot of the liquid crystal display unit 6.

Next, the function of each part of the liquid crystal display control device will be described.

Figure 3:
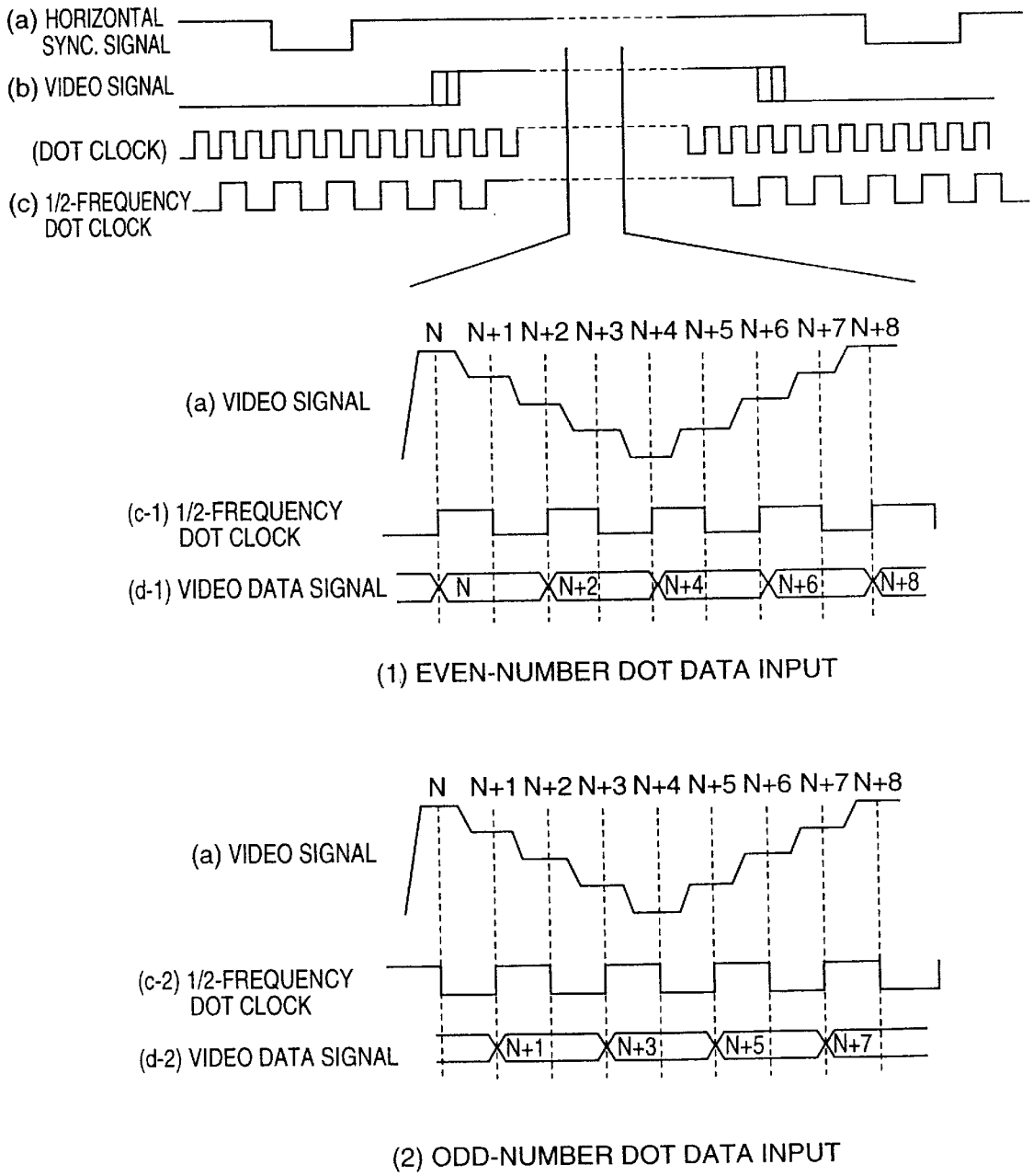
FIG. 3 is a diagram showing a data pickup timing of a liquid crystal display control device.

The PLL circuit 1 generates a ½-frequency dot clock on the basis of the input horizontal synchronous signal. As shown in FIG. 3, the ½-frequency is synchronized with the input video signal and has a double period of the dot period of the input video signal.

Figure 4A:
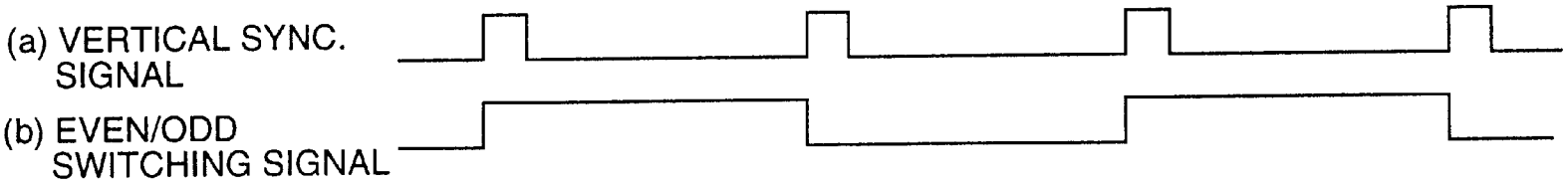
FIGS. 4A and 4B are diagrams showing phase control of a synchronous signal generating circuit.
Figure 4B:
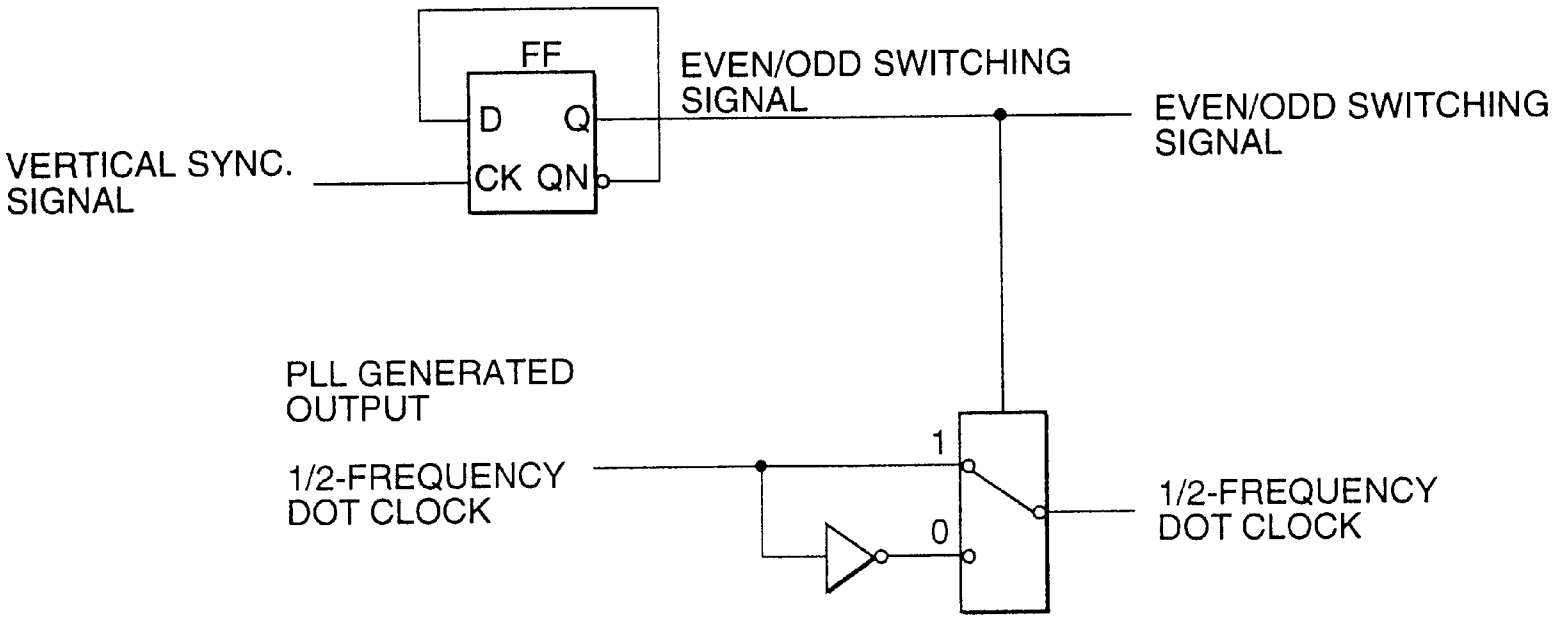

The synchronous signal generating circuit 2 generates an even-number/odd-number switching signal on the basis of the input vertical synchronous signal. As shown in FIG. 4A, the even-number/odd-number switching signal is synchronized with the input vertical synchronous signal and the logic level (high, low) is inverted every period of the vertical synchronous signal.

The synchronous signal generating circuit 2 is supplied with the ½-frequency dot clock from the PLL circuit 1, and controls the phase of the ½-frequency dot clock in accordance with the even-number/odd-number switching signal generated by itself. The synchronous signal generating circuit 2 of this embodiment has a circuit shown in FIG. 4B, and controls to invert the logic level of the ½-frequency dot clock in accordance with the logic level of the even-number/odd-number switching signal as shown in (1) and (2) of FIG. 3.

The A/D conversion circuit 3 converts an input video signal (analog data) to display data (digital data) on each rising edge of the ½-frequency dot clock which is controlled in phase in the synchronous signal generating circuit 2, and outputs the display data thus obtained, whereby the display data of dots on even-numbered columns (even-numbered dot data) N, N+2, N+4, . . . on each horizontal line of the input video signal are successively output during one period of the input vertical synchronous signal as shown in (1) of FIG. 3.

During a next period, the display data of dots on odd-numbered columns (odd-numbered dot data) N+1, N+3, N+5, . . . on each horizontal line of the input video signal are successively output as shown in (2) of FIG. 3 because the logic level of the ½-frequency dot clock is inverted due to the phase control. The operations of (1) and (2) of FIG. 3 are alternately repeated.

Figure 2:
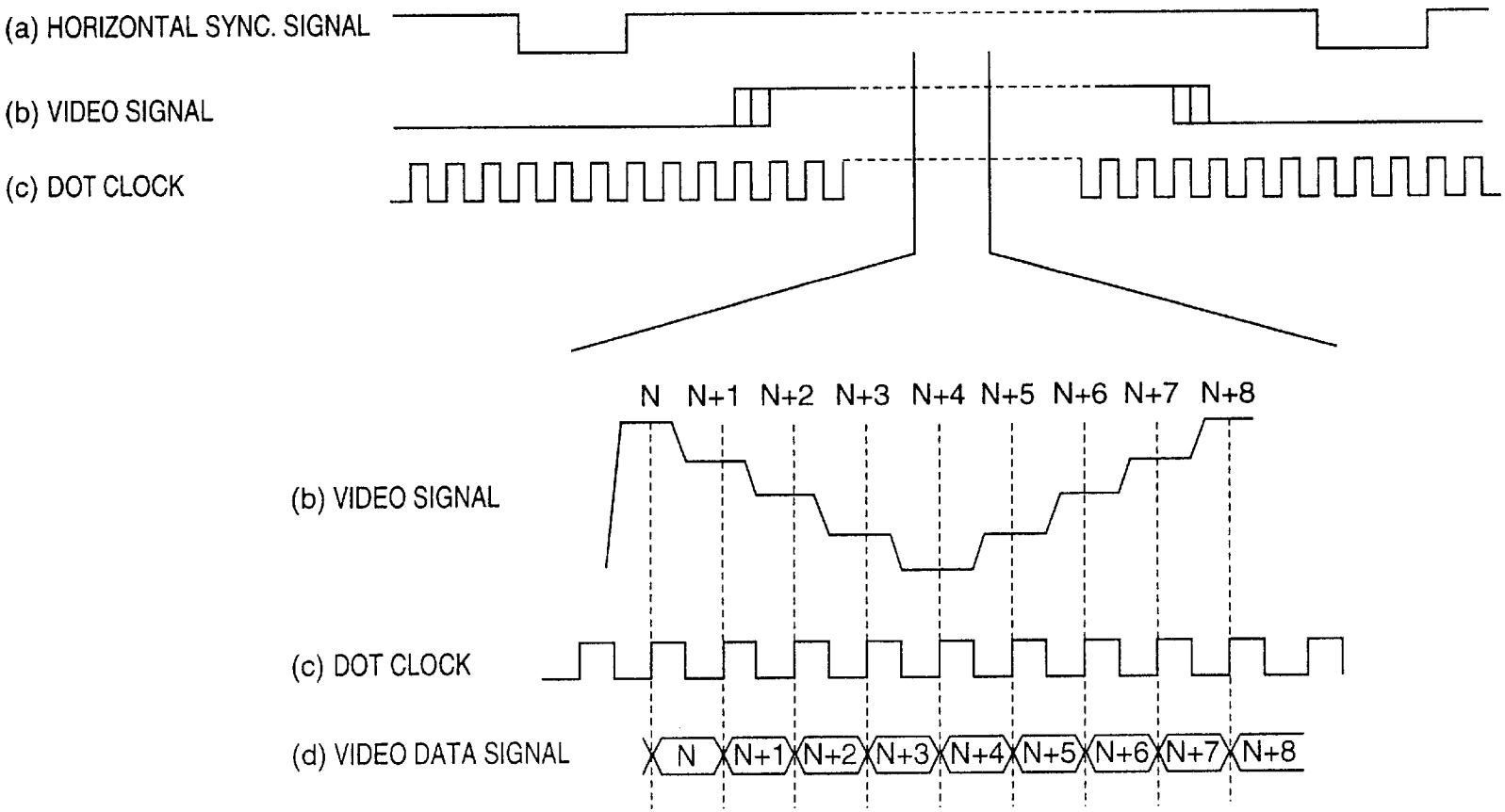
FIG. 2 PRIOR ART
FIG. 2 is a diagram showing a dot clock generated in a conventional display device.

In the prior art, as shown in FIG. 2, the PLL circuit generates, on the basis of the input horizontal synchronous signal (a), a dot clock (c) which is synchronized with the data of the input video signal (b) N, N+1, N+2, . . . and whose period is equal to the dot period of the input video signal. Therefore, it is necessary for circuits which can be operated at high speed to be used for parts associated with generation of the video signal for liquid crystal display. On the other hand, in this embodiment, the frequency of the ½-frequency dot clock serving as the reference operating clock is equal to ½, and thus the operating speed required for the circuits is greatly reduced.

The liquid crystal display controller 4 is supplied with the input vertical synchronous signal, the input horizontal synchronous signal, the display data from the A/D conversion circuit 3, the ½-frequency dot clock from the synchronous signal generating circuit 2 and the even-number/odd-number switching signal. On the basis of the signal group thus input, it generates and outputs the output synchronous signal and the output video signal for the liquid crystal display unit 6.

The liquid crystal display controller 4 functions to performing read/write control of display data from/into the frame memory 5. In the write control, the display data are stored into the frame memory 5 on a dot basis in accordance with the ½-frequency dot clock. At this time, the display data are stored at the position in the frame memory 5 which corresponds to the display position of the liquid crystal display panel.

The display data are picked up every other dot in the horizontal line direction of the display frame, and thus they are also stored in the frame memory 5 so as to be spaced from one another at fixed intervals. The display data are picked up in two periods of the input vertical synchronous signal, and thus the display data of one frame are stored in the arrangement corresponding to the display position thereof. In the read control, the display data in the frame memory 5 are successively read out every dot from the head storage position to the last storage position in synchronism with the output synchronous signal. The data thus read out are processed and then output as the output video signal.

Figure 21:
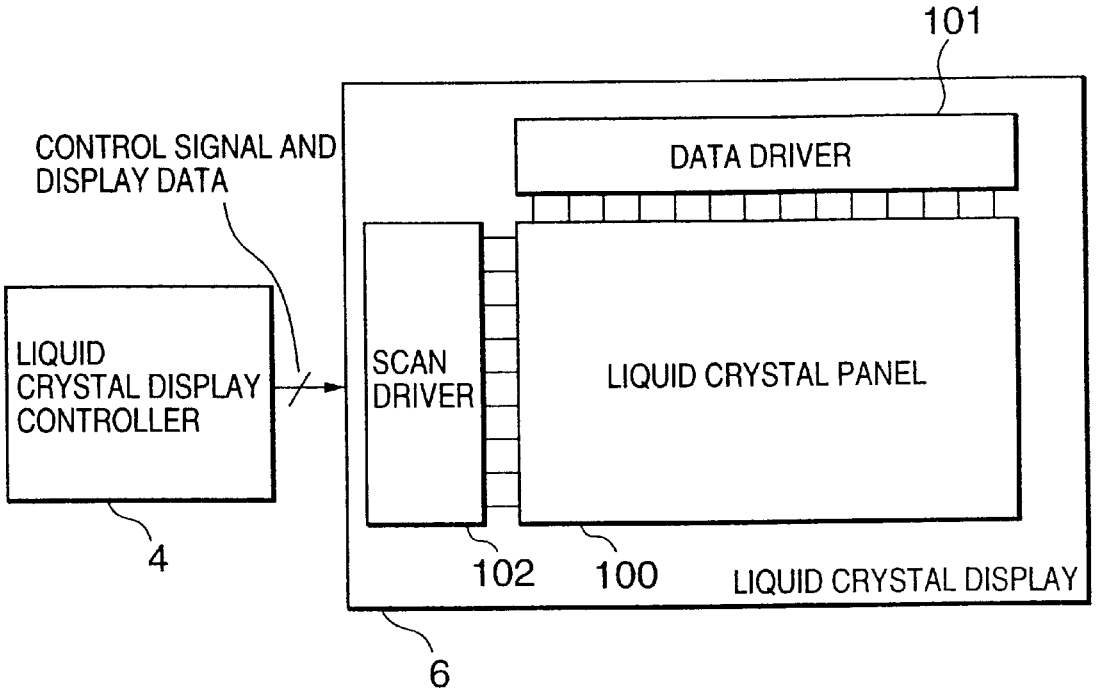
FIG. 21 is a diagram showing the construction of a liquid crystal display unit 6.

As shown in FIG. 21, the liquid crystal display unit 6 comprises a dot-matrix type liquid crystal panel 100 having liquid crystal pixels arranged in a matrix form, a data driver 101 and a scan driver 102. The scan driver 102 successively selects lines of the liquid crystal panel every line or every plural lines in accordance with the output synchronous signal. The data driver 101 picks up the display data of the output video signal in accordance with the output synchronous signal, holds all the display data of the selected lines, and applies a gradation voltage corresponding to each display data held to the liquid crystal panel. Through this operation, a color display is achieved on the liquid crystal panel.

The correlation of the input video signals is very high over plural continuous periods of the input vertical synchronous signals. Therefore, even when the dot data are picked up from the input video signal discretely on the time axis and the display data of one frame are picked up over plural continuous periods, the deterioration in image quality of display images is suppressed to a negligible level.

Next, the liquid crystal display control circuit 4 and the frame memory 5 will be described in more detail.

Figure 5:
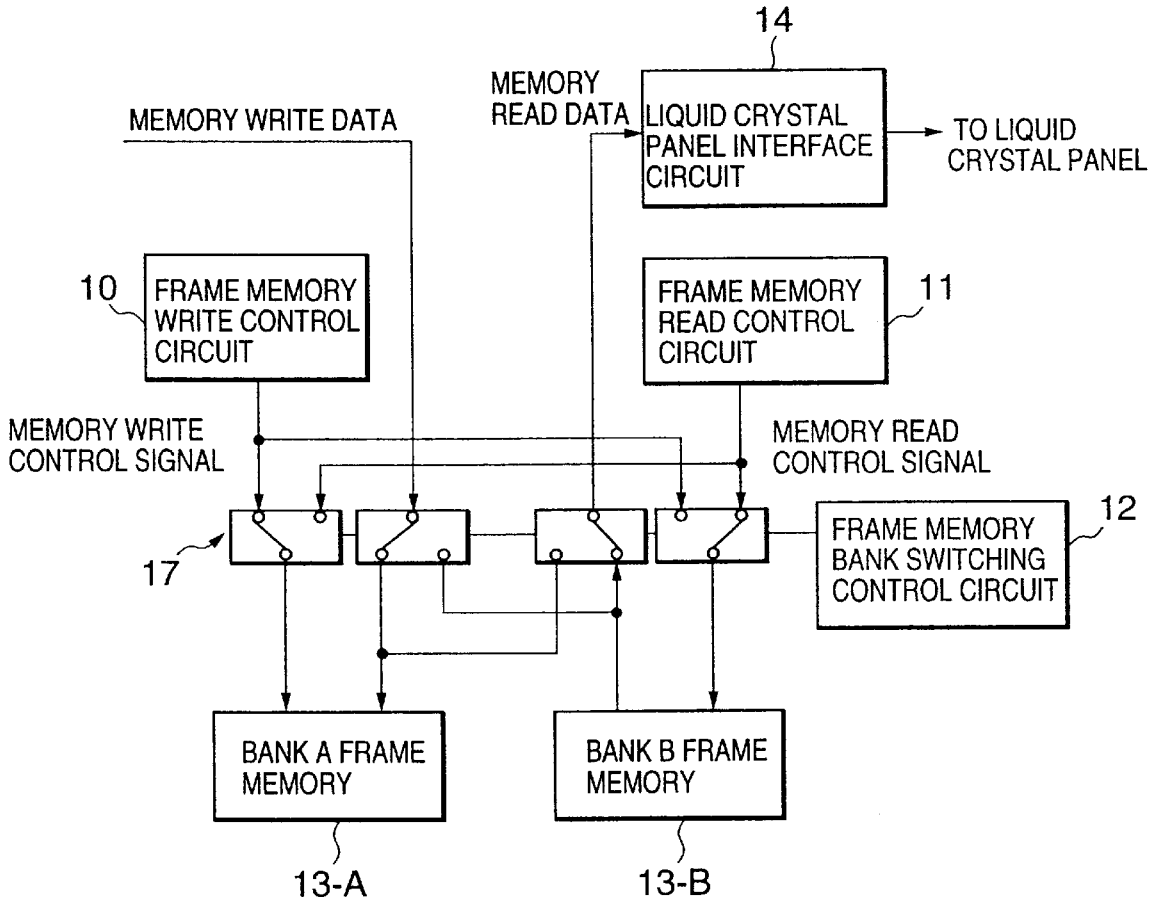
FIG. 5 is a diagram showing the function of a liquid crystal display controller 4 and a frame memory 5.

FIG. 5 schematically shows the construction of the frame memory 5 and the liquid crystal display controller. As shown in FIG. 5, the frame memory 5 comprises two bank memories 13 (bank A bank memory 13-A, bank B bank memory 13-B). Each bank memory 13 has a memory capacity with which the display data of one frame display can be stored. These bank memories 13 are designed so that one memory is subjected to the read control during the period for which the other memory is subjected to the write control of the display data.

The liquid crystal display controller 4 includes a frame memory write control circuit 10, a frame memory read control circuit 11, a switch circuit 17 and a frame memory bank switching control circuit 12 which switch the bank memories 13 as write-control and read-control targets, a liquid crystal panel interface circuit 14 for converting the read-out display data to the display data for the liquid crystal display, and a driving clock generating circuit (not shown) for generating a driving clock for the output synchronous signal and the internal circuit.

Each of the frame memory write control circuit 10 and the frame memory read control circuit 11 generates a control signal and an address signal to be supplied to the corresponding bank memory 13. The signals generated in the control circuits 10 and 11 are supplied through the switch circuit 17 to the different bank memories 13, respectively.

The frame memory bank switching control circuit 12 controls the switch circuit 17 to switch the bank memories 13 targeted for the write control and the read control. The switching timing is set to be just after the last display data of the display data of one frame are read out from the frame memory 5. However, in this case, when halfway data of one horizontal line of the input signal are written into the other bank memory 13, the switching operation is carried out after the write-in of the last display data of one horizontal line is completed. The switching timing of the bank memories 13 may be set to be just after the last display data of the display data of one frame are written into the frame memory 13.

Here, the driving clocks to be supplied to the frame memory read control circuit 11, the frame memory bank switching control circuit 12, the bank memory 13 which is targeted to be subjected to the read-control (hereinafter referred to as "read-control target bank memory"), and the liquid crystal panel interface driving circuit 14 are set to be in synchronism with the output synchronous signal. The driving clocks to be supplied to the frame memory write control circuit 11 and the bank memory 13 which is targeted to be subjected to the write-control (hereinafter referred to as "write-control target bank memory") are set to be in synchronism with the input synchronous signal and the ½-frequency dot clock.

In a simple example, when the period of the input vertical synchronous signal is set to 10 ms (=100 Hz) and the period of the output vertical synchronous signal is set to 20 ms (=50 Hz), the input video signal of about two frames is input during a period (20 ms) in which one-frame display is carried out on the liquid crystal panel. In this case, both the even-numbered dot data and the odd-numbered dot data are sequentially stored in the bank memories 13.

Figure 6:
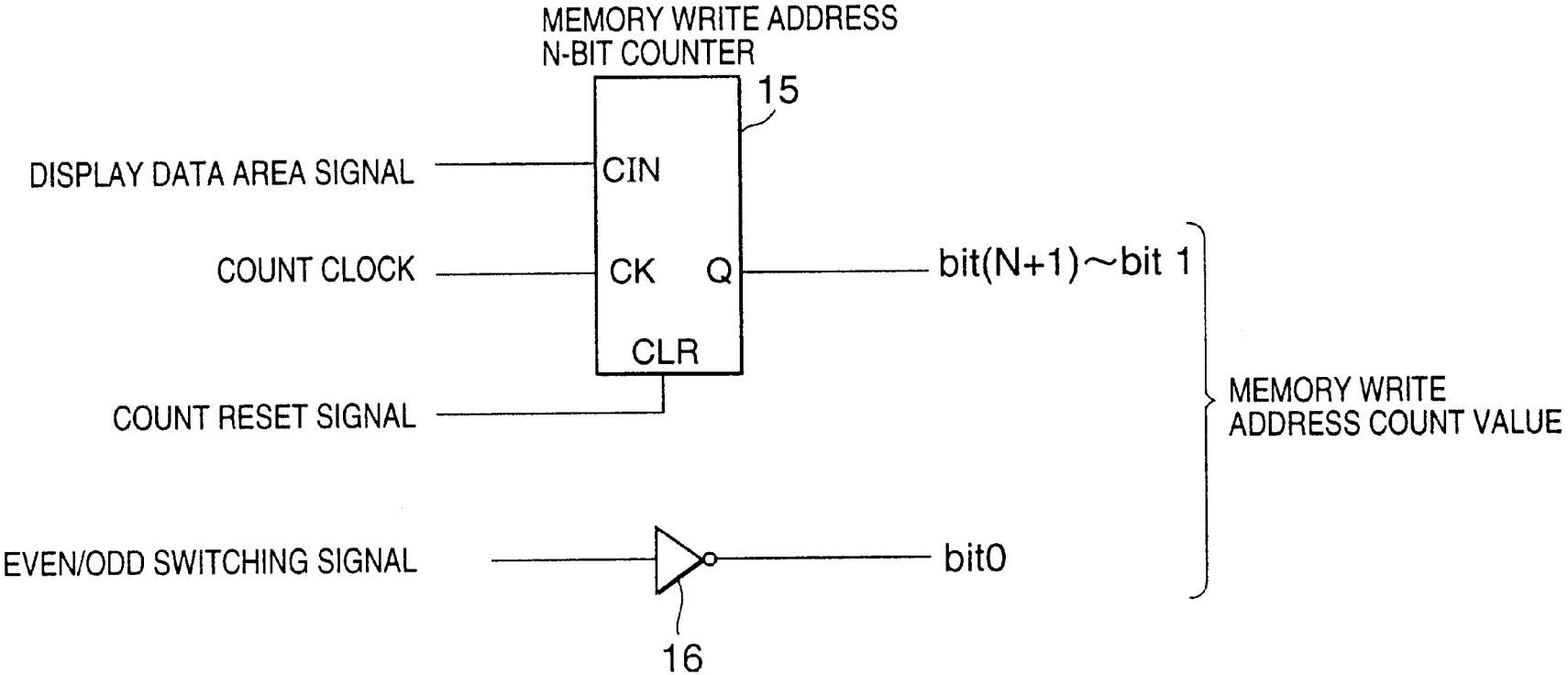
FIG. 6 is a diagram showing a write address generating circuit.

FIG. 6 shows the construction of the write address generating circuit in the frame memory write control circuit 10. As shown in FIG. 6, the write address generating circuit has an up-counter 15 and an inverter 16. The inverter 16 logically inverts the even-number/odd-number switching signal, and outputs a result thereof as the least significant bit (bit0) of the write address. The up-counter 15 counts up in accordance with the input of CK terminal during a period when the input of CIN terminal is kept at a high level, and resets the count value Q in response to an input to the CLR terminal. The count value Q is output as the upper N bits (bit 1 to bit N+1) of the write address. The terminals CIN, CK, CLR supplied with a display data area signal, a count clock and a count reset signal, respectively.

Figure 7:
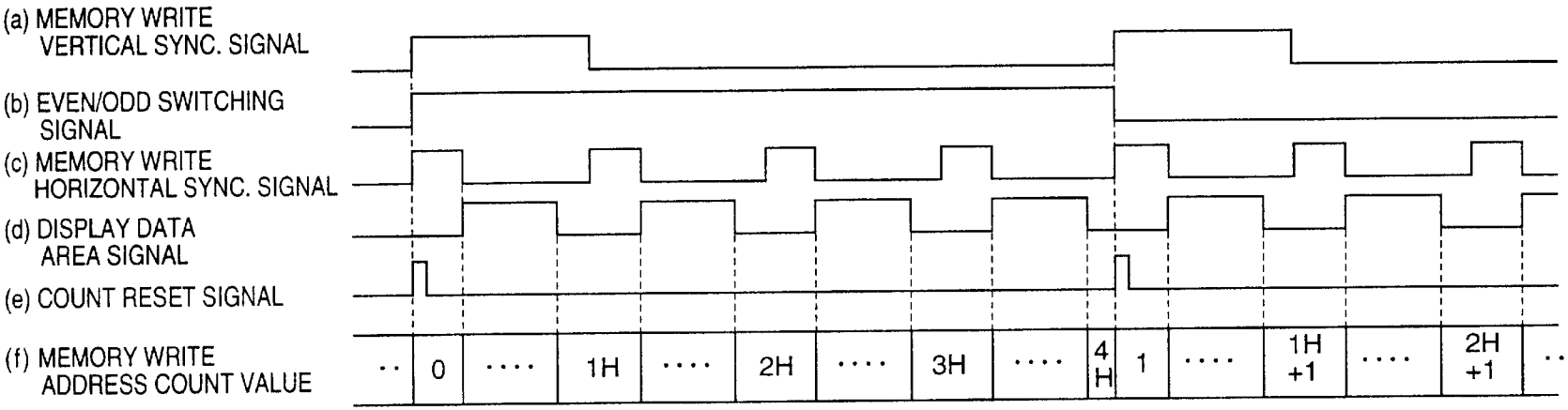
FIG. 7 is a diagram showing the operation of the write address generating circuit.

The operation of the write address generating circuit will be described with reference to FIG. 7. In FIG. 7, a memory write vertical synchronous signal (a) and a memory write horizontal synchronous signal (c) are set to be in synchronism with the input vertical synchronous signal and the input horizontal synchronous signal, respectively. The display data area signal (d) is to give the period during which effective data in the input video signal are transmitted. The count reset signal (e) is to reset the up-counter 15 on the rising edge of the memory write vertical synchronous signal (a). Further, the count clock input to the up-counter 15 is in synchronism with the phase-controlled ½-frequency dot clock. The write addresses of the bank memories 13 in which the display data at the head of each horizontal line of one frame are stored are set to '0', 1H, 2H, 3H, . . . respectively. Here, H represents the number of dots on one horizontal line.

In the period of the input vertical synchronous signal during which the even-number/odd-number switching signal is set to high level (hereinafter referred to as "input frame period"), the address count value (f) is synchronized with the ½-frequency dot clock, and varies as follows: '0', '2', '4', . . . 1H, 1H+2, . . . , whereby the odd-numbered dot data are stored in the frame memory 5. When a next input frame period starts, the up-counter 15 is reset and the even-number/odd-number switching signal is set to low level. Therefore, the memory write address count value (f) varies as follows: '1', '3', '5', . . . , 1H+1, 1H+3, . . . , whereby the even-numbered dot data are stored in the frame memory 5. The memory write address count value (f) repeats the above variation for every input frame period.

The frame memory read control circuit 11 generates a read address which varies one by one like '0', '1', '2', . . . , 1H, 1H+1, . . . , and sequentially reads out the display data of one frame from the frame memory 5. The display data thus read out are processed in the liquid crystal panel interface circuit 14, and then output as the output video signal to the liquid crystal display unit 6.

A dual port memory having a memory capacity corresponding to the display data of one frame may be used as the frame memory 5. The dual port memory includes two pairs each comprising an input port for the address signal and the control signal and a data input/output port. By using one pair only for writing and the other pair only for reading, the read-control and the write-control of display data can be performed individually and in parallel. By using the dual port memory, the access control is simplified and new display data in the input stage can be output to the liquid crystal display unit 6.

The above-described liquid crystal display control device may be disposed together with the liquid crystal display unit 6 in the same single housing. This arrangement can implement a liquid crystal display device which is directly connected to a computer to perform a display operation as in the case of a conventional CRT display device. This liquid crystal display device can be readily replaced by a CRT display device connected to a computer.

Figure 8:
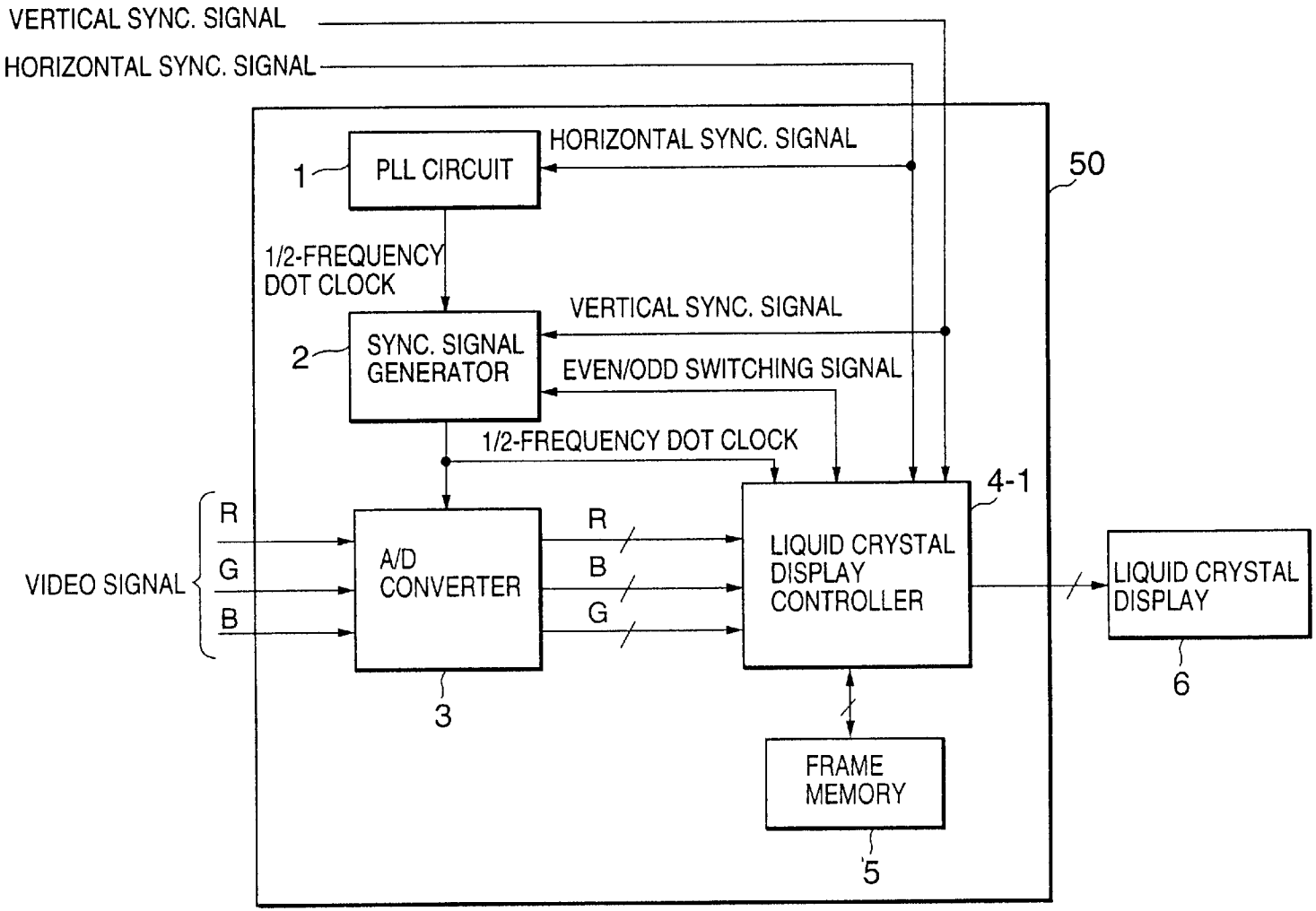
FIG. 8 is a diagram showing an embodiment of a 1-chipped liquid crystal control device.
Figure 9:
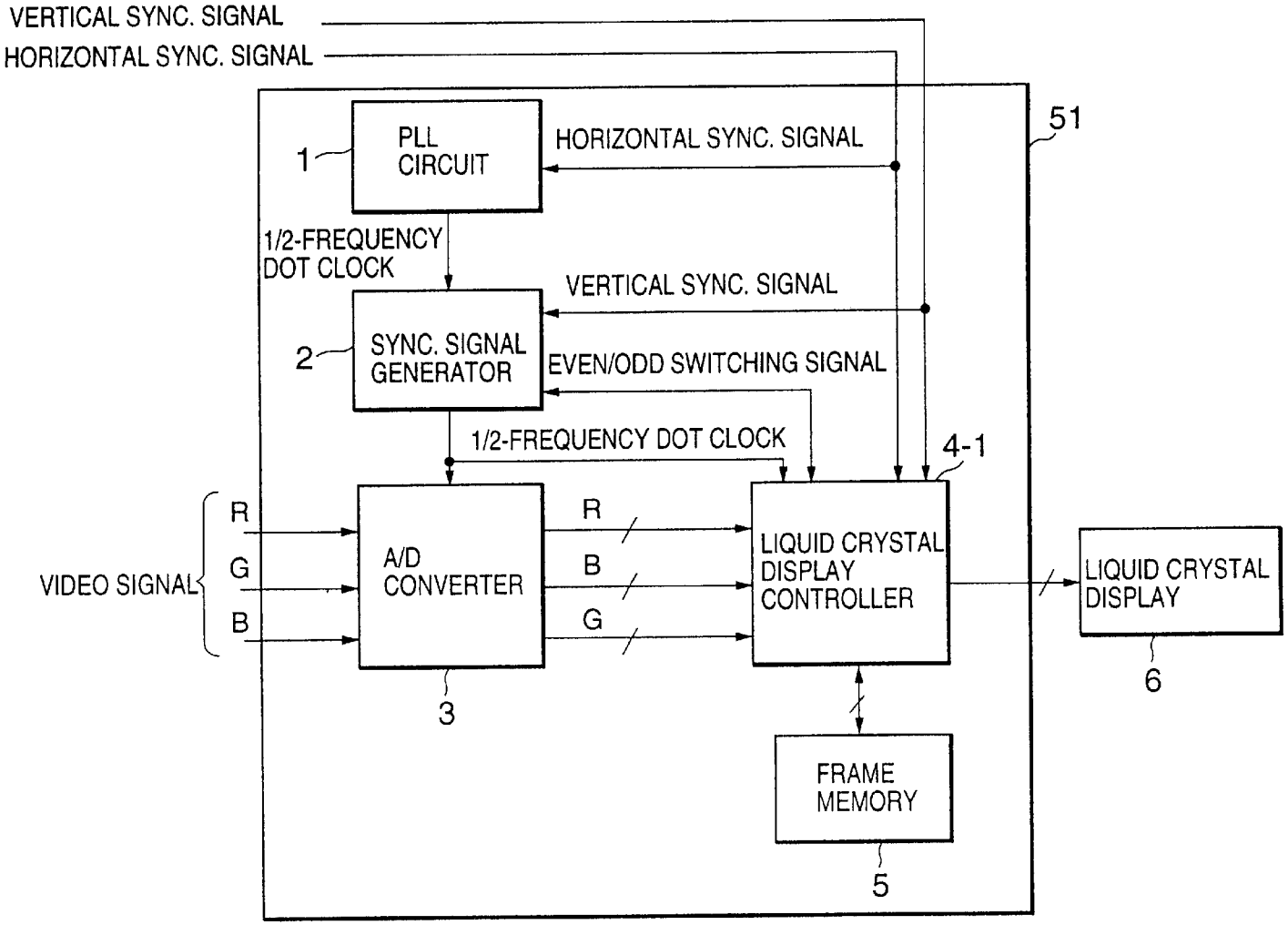
FIG. 9 is a diagram showing another embodiment of the 1-chipped liquid crystal display control device.

Further, each of the circuits 1 to 4 constituting the liquid crystal display control device can be readily implemented in an integrated circuit. Therefore, as shown in FIG. 8, each of the circuits 1 to 4 of the liquid crystal display control device can be implemented in a 1-chip LSI 50. Further, as shown in FIG. 9, an LSI 51 containing the frame memory 5 therein may be implemented. Such a 1-chip design enables miniaturization of a liquid crystal display control device and reduction in power consumption. Further, with the 1-chip design, the liquid crystal display control device of this embodiment can be readily installed into a liquid crystal display device for which a compact design and a low power consumption are advantageous.

As described above, the liquid crystal display control device of this embodiment can operate with the reference operating clock whose speed is equal to a half of the speed of the input video signal, in order to display images on the liquid crystal panel. Since the speed of the reference operating clock can be reduced, inexpensive circuits which are low in permissible maximum speed and in price can be used as the internal circuits 1 to 5, and also occurrence of noise and the power consumption can be suppressed.

Next, a liquid crystal display control device according to a second embodiment of the present invention will be described with reference to FIGS. 10 and 11.

The liquid crystal display control device according to this embodiment performs such a control operation that one of a function of picking up the data of the input video signal every other dot (the function of the first embodiment) and a function of picking up the data of the input video signal every dot is selectively enabled in accordance with the speed of the input video signal.

Figure 10:
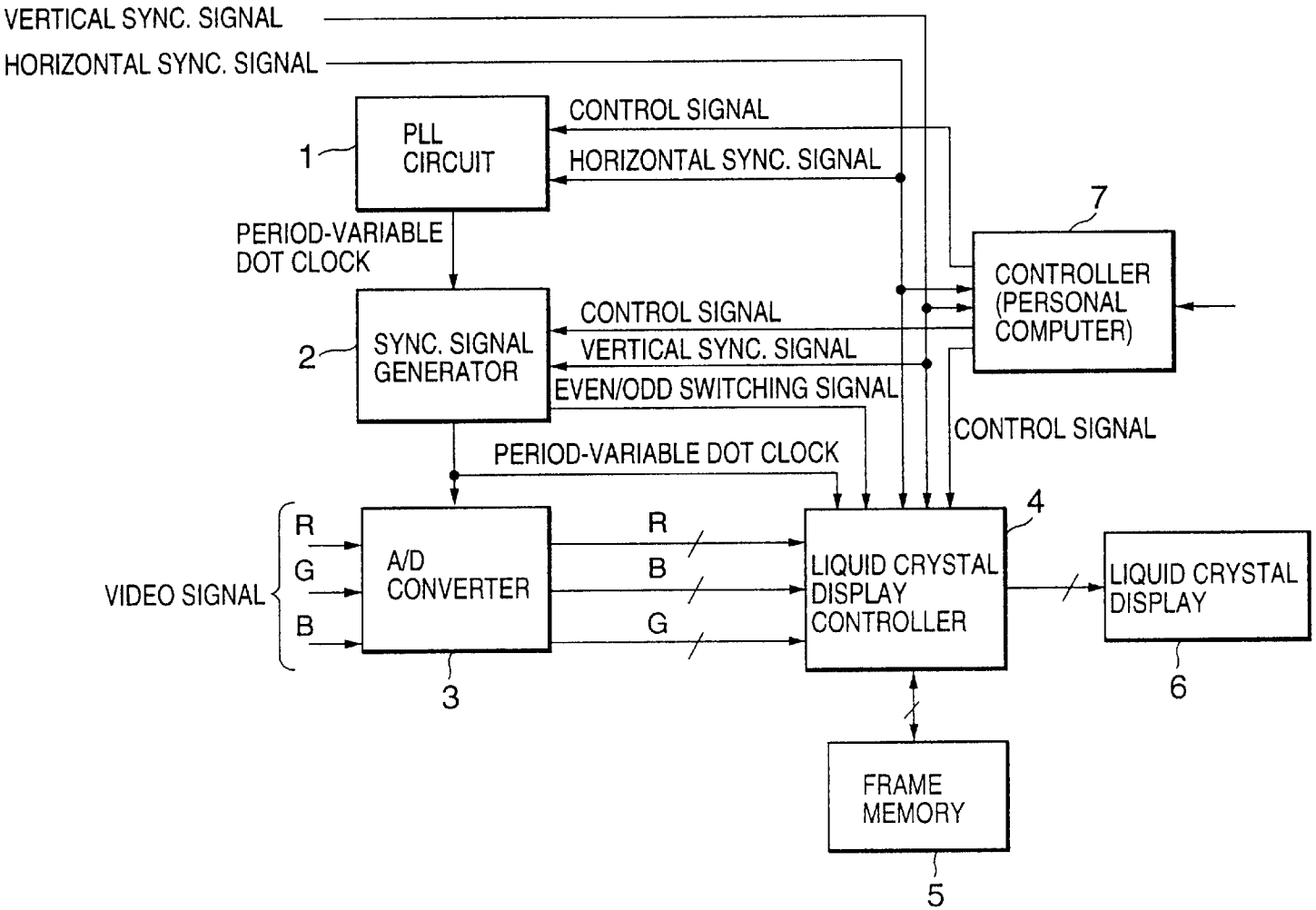
FIG. 10 is a diagram showing a liquid crystal display control device according to a second embodiment of the present invention.
Figure 11:
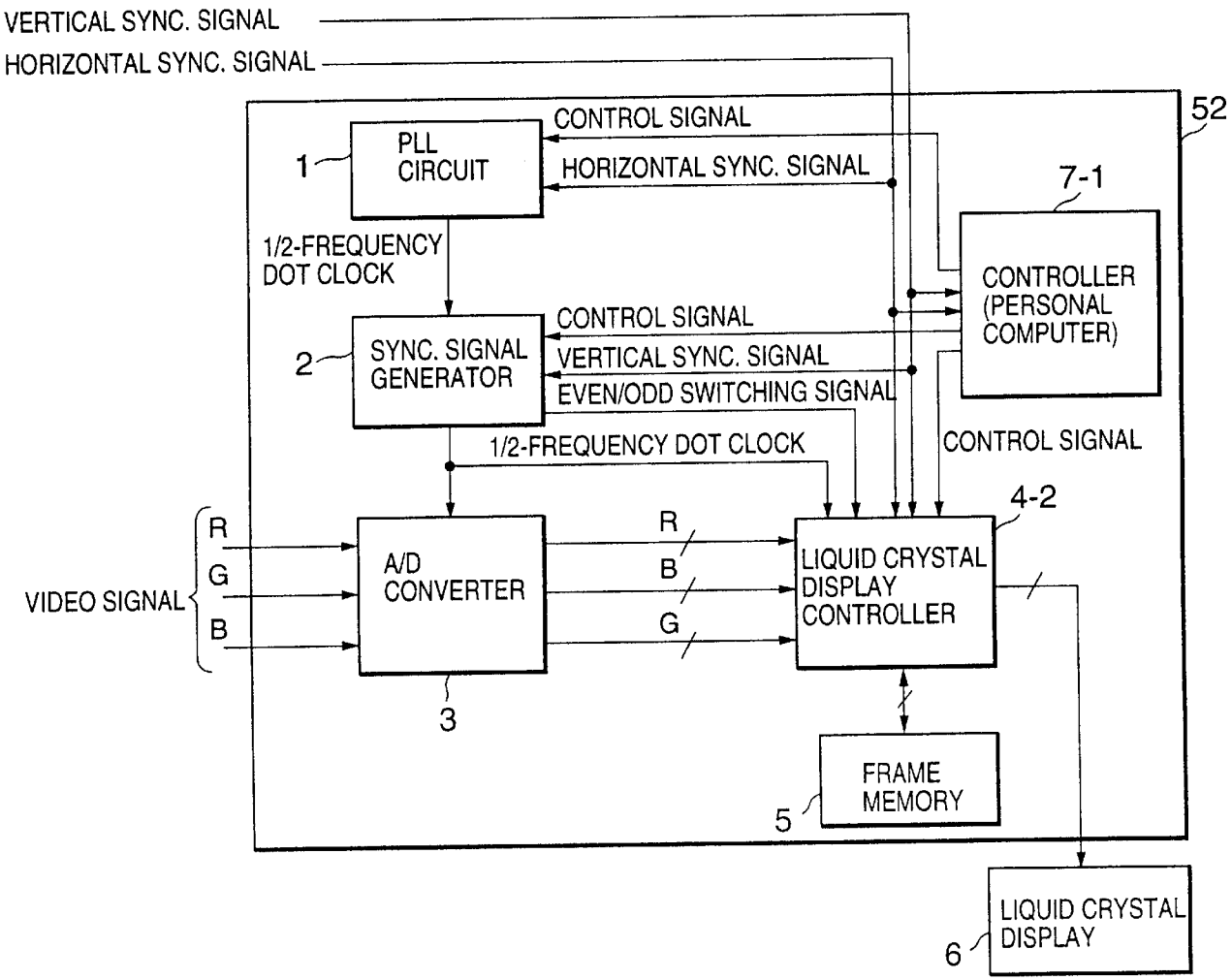
FIG. 11 is a diagram showing an embodiment of a 1-chipped liquid crystal display control device.

FIG. 10 is a block diagram showing the construction of the liquid crystal display control device of this embodiment. In FIG. 10, the parts corresponding to the elements of FIG. 1 are represented by the same reference numerals. As shown in FIG. 10, the liquid crystal control device has a controller 7 comprising a processor (microcomputer). The controller 7 determines the dot speed of the input video signal and the operation mode in the liquid crystal display control device on the basis of the input synchronous signal, and outputs a result thereof as a control signal. As the operation mode there are provided an intermittent mode in which the data of the input video signal is picked up every other dot, and a continuous mode in which the data of the input video signal is picked up every dot. When the operation mode is set to the intermittent mode, the liquid crystal display control device is operated in the same manner as the first embodiment.

Each of the PLL circuit 1, the synchronous signal generating circuit 2 and the write control circuit of the liquid crystal display controller 4 is provided with a function to support the continuous mode in addition to the functions of the liquid crystal display control device of FIG. 1. The following description will concentrate on those parts that are different from the first embodiment.

The PLL circuit 1 generates a period-variable dot clock having a double period of the dot period of the input video signal in the intermittent mode, and also generates a period-variable dot clock having a period coincident with the dot period of the input video signal in the continuous mode. Here, a frequency-dividing circuit (not shown) in which the frequency dividing ratio is variable is inserted in the feedback loop of the PLL circuit 1. A period-variable dot clock having a desired period can be generated by changing the frequency-dividing ratio in accordance with a control signal.

The synchronous signal generating circuit 2 is supplied with the period-variable dot clock in place of the ½-frequency dot clock, and performs the same operation as the first embodiment in the intermittent mode. In the continuous mode, the even-number/odd-number switching signal is fixed to high level, and the period-variable dot clock is directly output without being subjected to the phase control.

The liquid crystal display controller 4 is also supplied with the period-variable dot clock in place of the ½-frequency dot, and performs the same operation as the first embodiment in the intermittent mode. In the continuous mode, it outputs a memory write address count value which varies one by one like '0', '1', '2', '3', . . . That is, a data switch circuit to which the control signal is input as a switch control input is inserted at the rear stage of the circuit of FIG. 6, and the count value of the up-counter 15 is output as the memory write address count value (bit0 to bitN). With this arrangement, the display data of the input video signal are successively stored every dot from the head position to the last position in the frame memory 5.

The circuit associated with the read control and the data output processing in the liquid crystal display controller 4 successively reads out the display data at a predetermined timing as in the case of the first embodiment irrespective of the speed of the input video signal and the operation mode, and outputs the display data thus read out to the liquid crystal display unit 6.

The speed of the input synchronous signal and information on the generated clock of the PLL circuit and the operation mode are registered in advance in association with each other in a built-in memory of the controller 7. The registration of the data into the built-in memory as described above is enabled because standardization in frame specification such as XGA, SXGA or the like has been established for personal computers, and this standardization enables determination of the speed of an input video signal and the resolution on the basis of the speed of an input synchronous signal.

The controller 7 starts a timer to measure the number of input synchronous signals which are input during a fixed period, and calculates each speed of the input vertical synchronous signal and the input horizontal synchronous signal. Further, it reads out the information corresponding to the speed from the built-in memory and outputs the information as a control signal.

With this operation, when the frame specification of the input signal of the liquid crystal display control device is XGA (1024 dots in a lateral direction—768 lines in vertical direction, a vertical synchronous signal frequency of 60 Hz, a horizontal synchronous signal frequency of 48.36 kHz, a dot period of 65 MHz), the PLL circuit generates a period-variable dot clock of 65 MHz, and the other circuits operate in the continuous mode. When the frame specification of the input signal is SXGA (1280 dots in lateral direction_1024 lines in vertical direction, vertical synchronous signal frequency of 85 Hz, horizontal synchronous signal frequency of 91.15 kHz, dot period of 157.5 MHz), the PLL circuit generates a period-variable dot clock of 78.75 MHz, and the other circuits operate in the intermittent mode. In this case, the liquid crystal display control device can be implemented by a circuit which satisfies the maximum permissible operating frequency of 80 MHz.

The capacity of the frame memory 5 and the resolution of the liquid crystal panel (the resolution of the output video signal) are determined so as to satisfy the maximum resolution of the input video signal. When the resolution of the input video signal is smaller than the resolution of the output video signal, the read control circuit 11 in the liquid crystal display controller 4 temporarily ceases the read-out of the data and outputs the dot data with which black color is displayed, whereby the display image of the input video signal is displayed on a part of the liquid crystal panel. For example, by performing the above control at the above read-out time of the last half of the display data on each horizontal line and all the display data of the last half horizontal lines of one frame, the display image of the input video signal is displayed at the left upper side on the liquid crystal panel.

In this embodiment, the controller 7 determines the clock frequency and the operation mode on the basis of the input synchronous signal. However, the mode signal may be supplied from the external to the controller 7 so that the controller 7 selects the clock frequency and the operation mode which are indicated by the mode signal.

Further, the liquid crystal display control device according to this embodiment may be disposed in the same single housing together with the liquid crystal display unit 6. As shown in FIG. 11, it may be implemented in a 1-chip LSI 52.

As described above, when the speed of the input video signal is high, the liquid crystal display control device of this embodiment is set to the intermittent mode to perform the display operation with the reference operating clock having a lower speed. On the other hand, when the speed of the input video signal is low, the display data at a newer input time point can be displayed with the reference operating clock having the same speed.

Next, a third embodiment according to the present invention will be described with reference to FIGS. 12 to 15.

Figure 12:
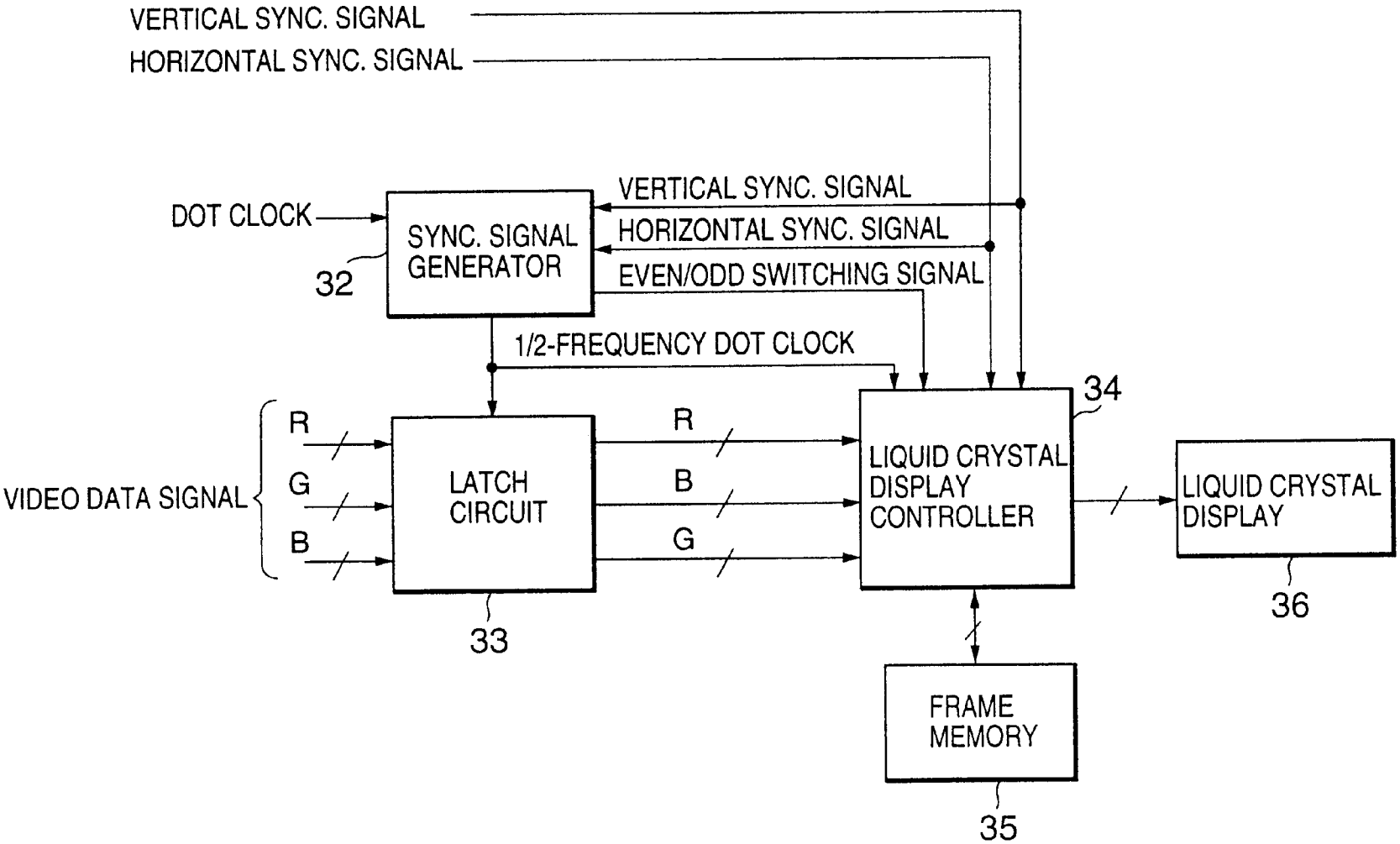
FIG. 12 is a diagram showing a liquid crystal display control device according to a third embodiment of the present invention.
Figure 13A:
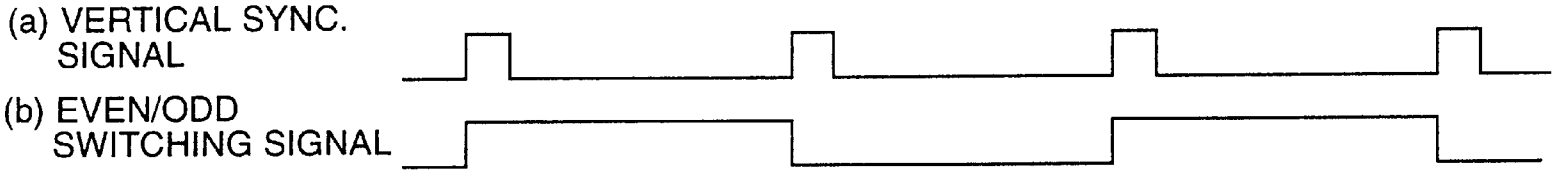
FIGS. 13A and 13B are diagram showing phase control of a synchronous signal generating circuit 32.
Figure 13B:
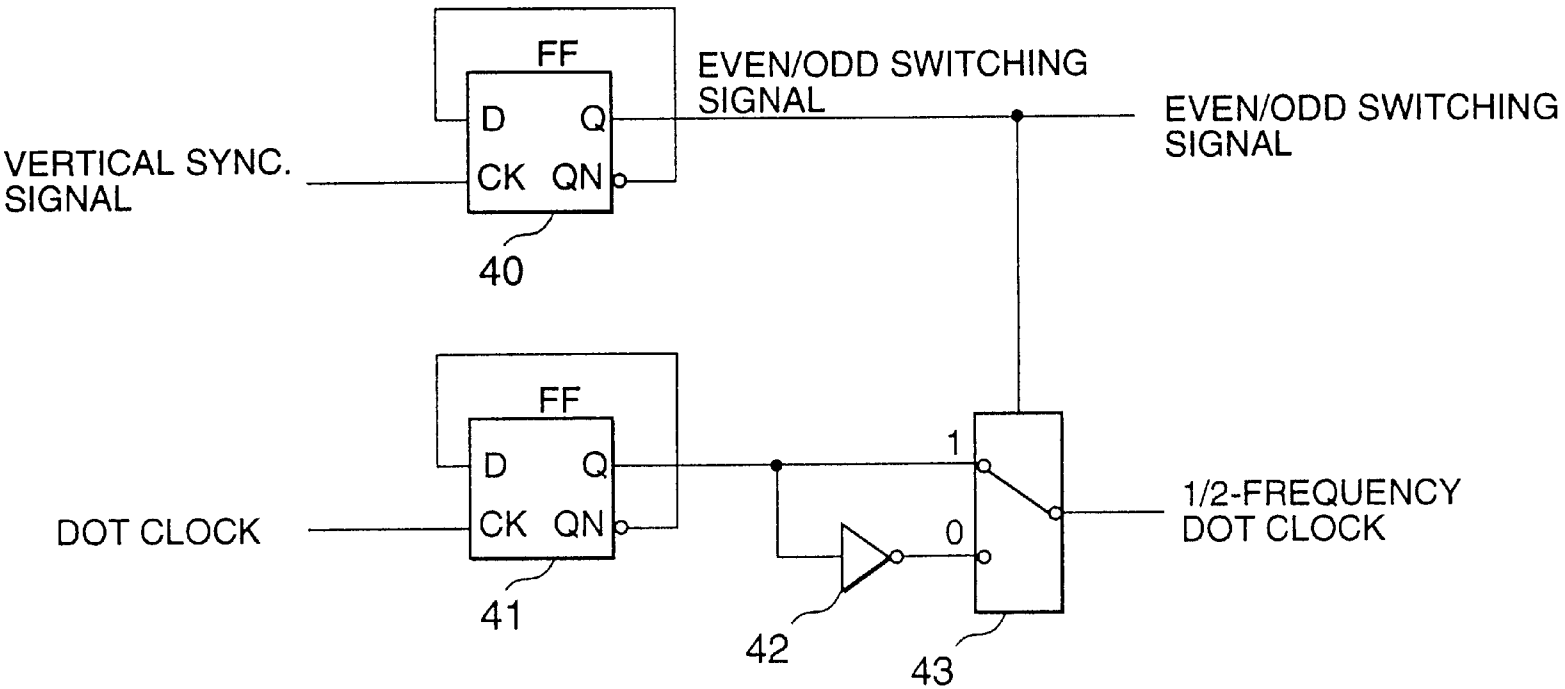

FIG. 12 is a block diagram showing the construction of a liquid crystal display control device according to the third embodiment of the present invention. The liquid crystal display control device of this embodiment is designed to support a computer having a digital video output. An input synchronous signal, input video signals (R,G,B) of digital data and a dot clock synchronized with the dot period of the video signals are input as input signals to the liquid crystal display control device.

As shown in FIG. 12, the liquid crystal display control device of this embodiment has a synchronous signal generating circuit 32, a latch circuit 33, a liquid crystal display controller 34, a frame memory 35 and a liquid crystal display unit 36. The liquid crystal display controller 34, the frame memory 35 and the liquid crystal display unit 36 have the same functions as those of the first embodiment.

The synchronous signal generating circuit 32 is different from that of the first embodiment in that it has a function of generating a ½-frequency dot clock on the basis of a dot clock input from the outside. The synchronous signal generating circuit 32 has a circuit shown in FIG. 13B. It divides the frequency of the input dot clock by 2 to achieve the ½-frequency dot clock, and also divides the frequency of the input vertical synchronous signal by 2 to generate an even-number/odd-number switching signal. As in the case of the first embodiment, the phase control of the ½-frequency dot clock to be output is performed in accordance with the even-number/odd-number switching signal.

Figure 14:
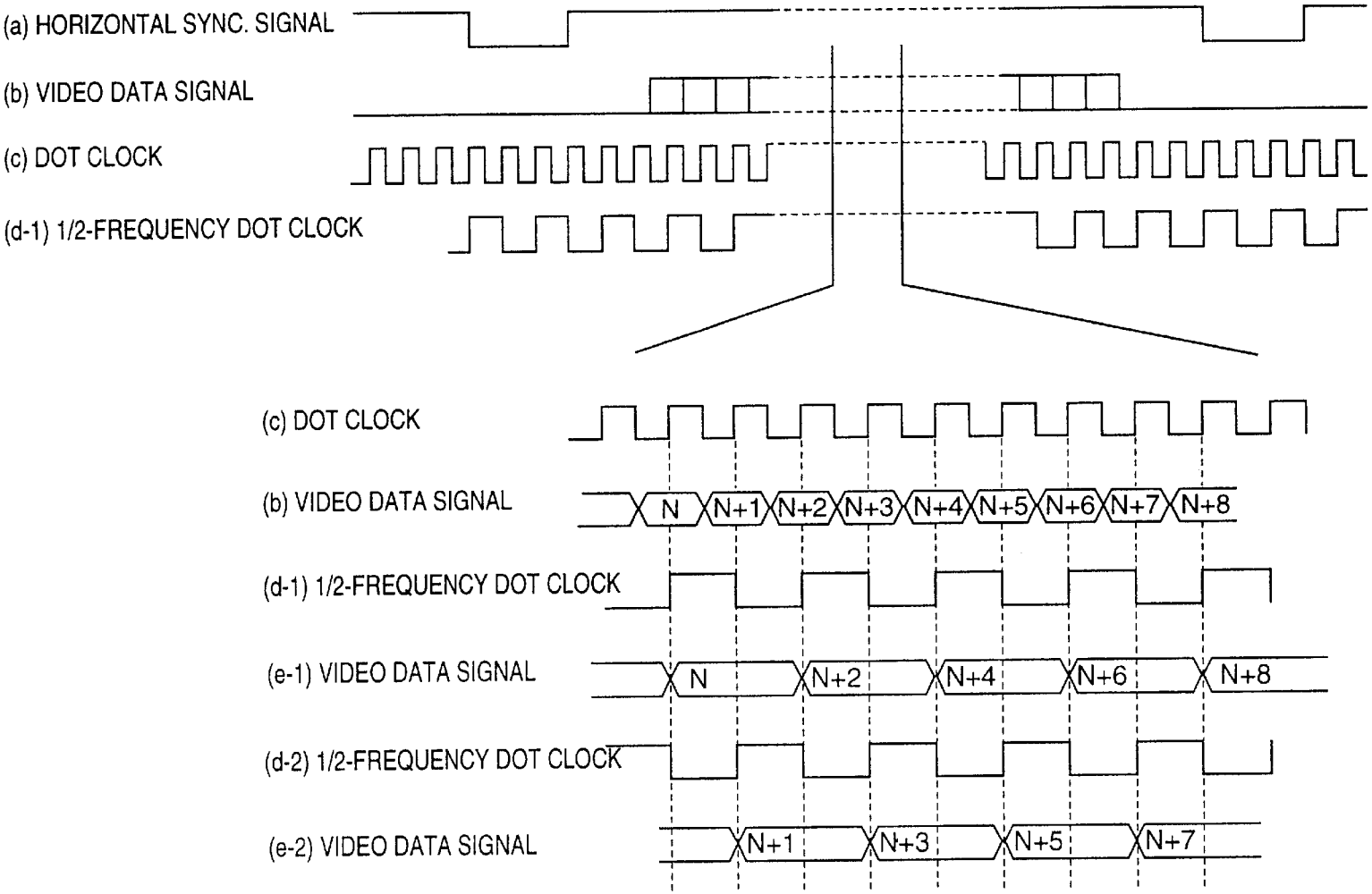
FIG. 14 is a diagram showing a data pickup timing.

The latch circuit 33 latches the input video signals (R,G, B) of digital data in accordance with the ½-frequency dot clock from the synchronous signal generating circuit 32 as shown in FIG. 14, whereby the digital data of the input video signal are transmitted to the liquid crystal display controller 34 every other dot as in the case of the first embodiment.

Every time the input frame period is switched, the ½-frequency dot clock is logically inverted, and the input of the input video signal is performed by the amount corresponding to the 2 input frame periods, whereby the display data of one frame are stored in the frame memory 35. The display data of one frame is sequentially read out and displayed on the liquid crystal display unit 36.

As described above, according to the liquid crystal display control device of this embodiment, for example, it is connected to a computer having a digital video output and performs display control by using, as a reference operating clock, a clock having a double period of the dot period of the input video signal.

Figure 15:
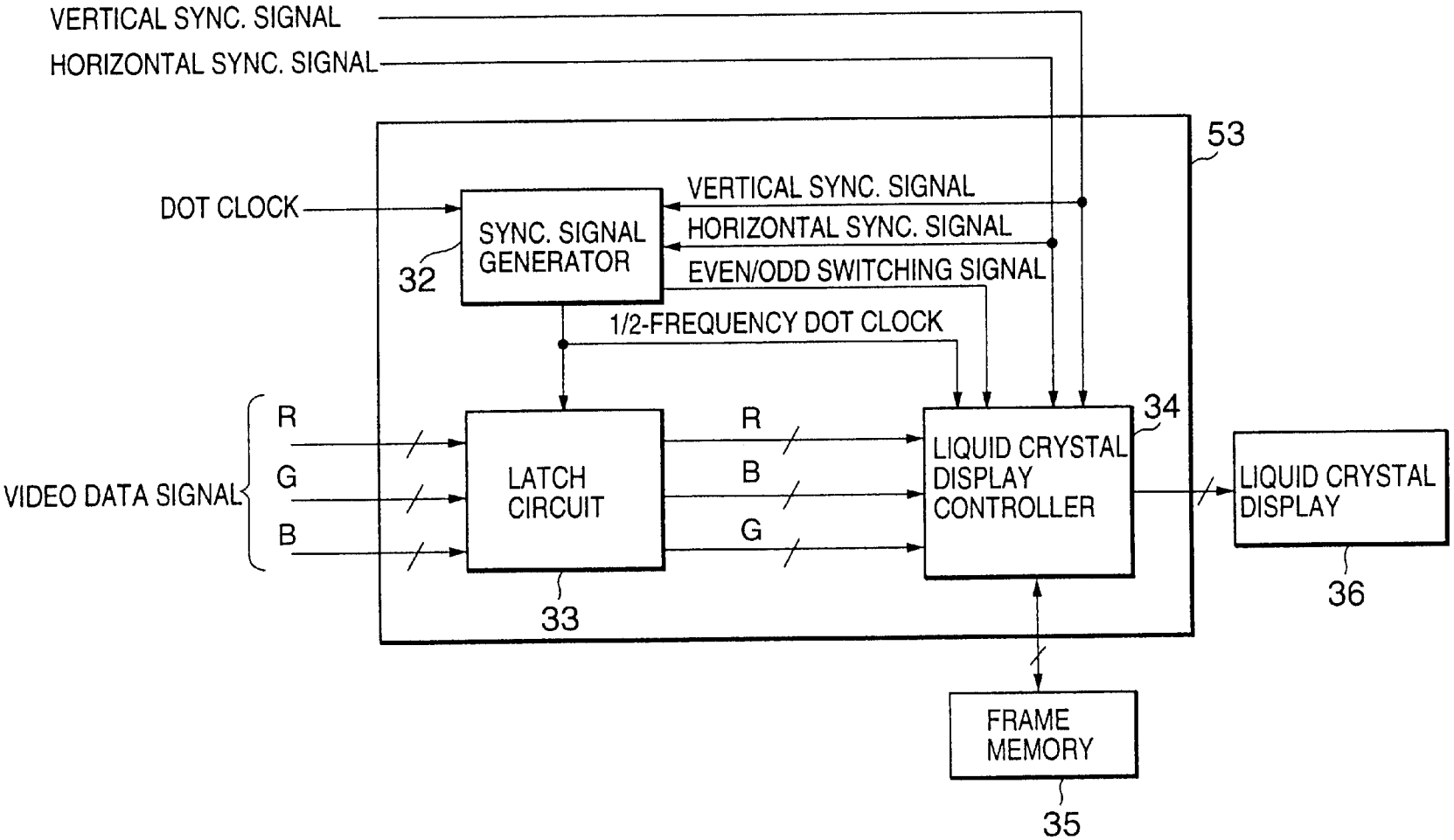
FIG. 15 is a diagram showing an embodiment of the 1-chipped liquid crystal display control device.

As shown in FIG. 15, the synchronous signal generating circuit 32, the latch circuit 33 and the liquid crystal display controller 34 may be disposed in a 1-chip LSI 53. Further, the frame memory 35 may be installed in the LSI 53.

Next, a fourth embodiment according to the present invention will be described with reference to FIG. 16.

Figure 16:
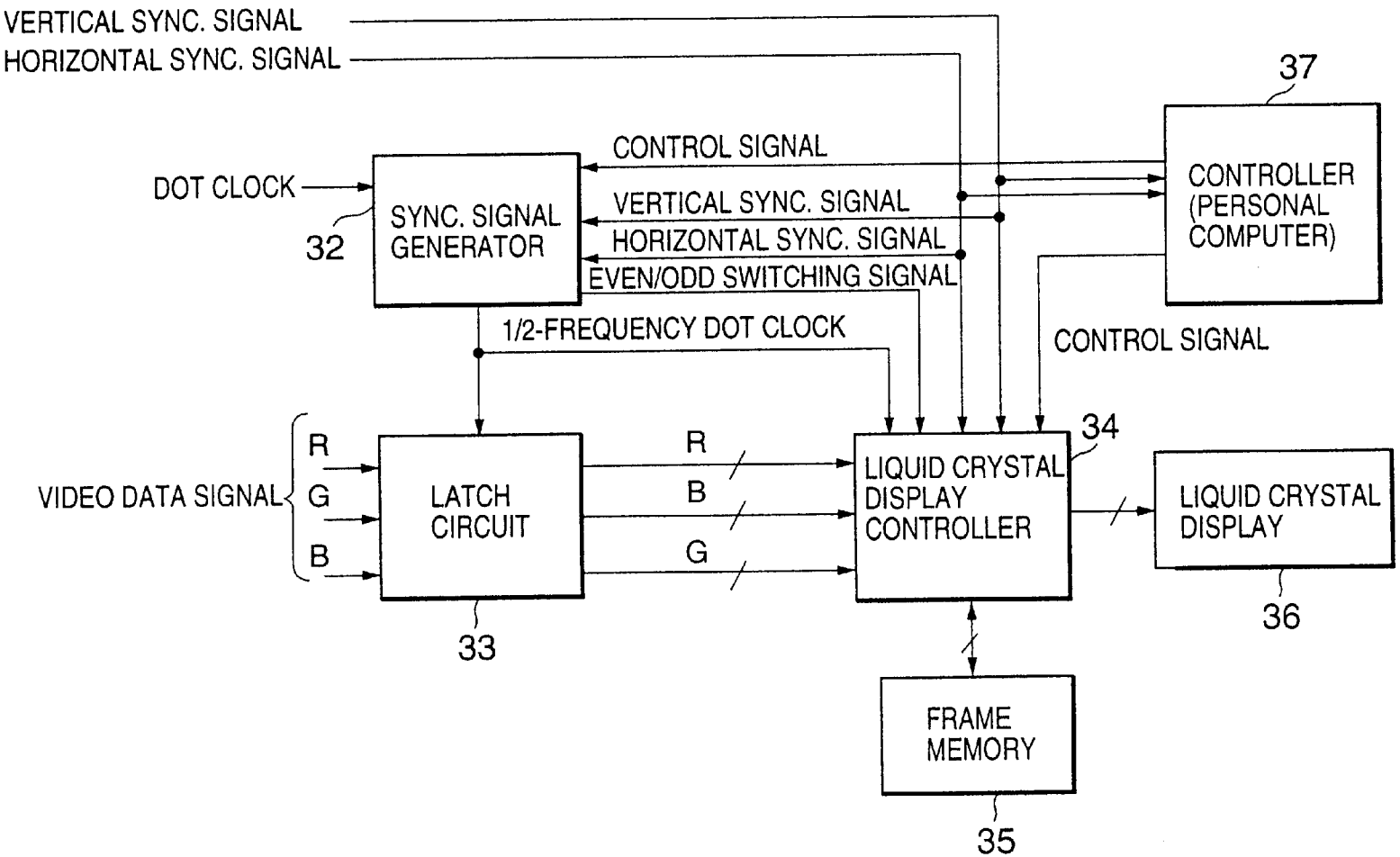
FIG. 16 is a diagram showing a liquid crystal display control device according to a fourth embodiment of the present invention.

FIG. 16 is a block diagram showing the construction of the liquid crystal display control device according to the fourth embodiment of the present invention. In the liquid crystal display control device of the fourth embodiment, the function to support the speed variation of the input video signal which is described with reference to the second embodiment is provided to the third embodiment which supports the computer having a digital video output.

A controller 7 has the same function as the second embodiment, and it determines the clock frequency and the operation mode (intermittent mode, continuous mode) on the basis of the input period signal and outputs a result thereof as a control signal.

The synchronous signal generating circuit 32 and the write control circuit of the liquid crystal display controller 34 of this embodiment are obtained by providing the corresponding circuits of FIG. 12 with the function to support the continuous mode. The synchronous signal generating circuit 32 performs the same operation as the third embodiment in the intermittent mode. In the continuous mode, it generates a period-variable dot clock whose period is coincident with the dot period of the input video signal. It sets the even-number/odd-number switching signal to a high level, and outputs the period-variable dot clock without performing the phase-control on the dot clock.

The liquid crystal display controller 34 is also supplied with the period-variable period dot clock in place of the ½-frequency dot clock, and it performs the same operation as the third embodiment in the intermittent mode. In the continuous mode, it outputs a memory write address count value varying one by one like '0', '1', '2', '3', . . . , whereby the dot data of the input video signal are successively stored from the head to the last of each frame in the frame memory 5 for every dot.

As described above, according to the present embodiment, for example, the liquid crystal display device is connected to a computer having a digital video output, and when the speed of the input video signal is high, the mode is set to the intermittent mode to perform the display operation with the reference operating clock having a lower speed. On the other hand, when the speed of the input video signal is low, display data at a newer input time point can be displayed with the reference operating clock having the same speed.

Next, an extended modification of the above-described liquid crystal display control devices will be described.

In the above embodiments, the period of the reference operating clock of the liquid crystal display control device is set to the same period as or double the period of the dot period of the input video signal. However, the present invention is not limited to these embodiments. For example, the period of the reference operating clock may be set to n-times the dot period (n represents a natural number).

Figure 17:
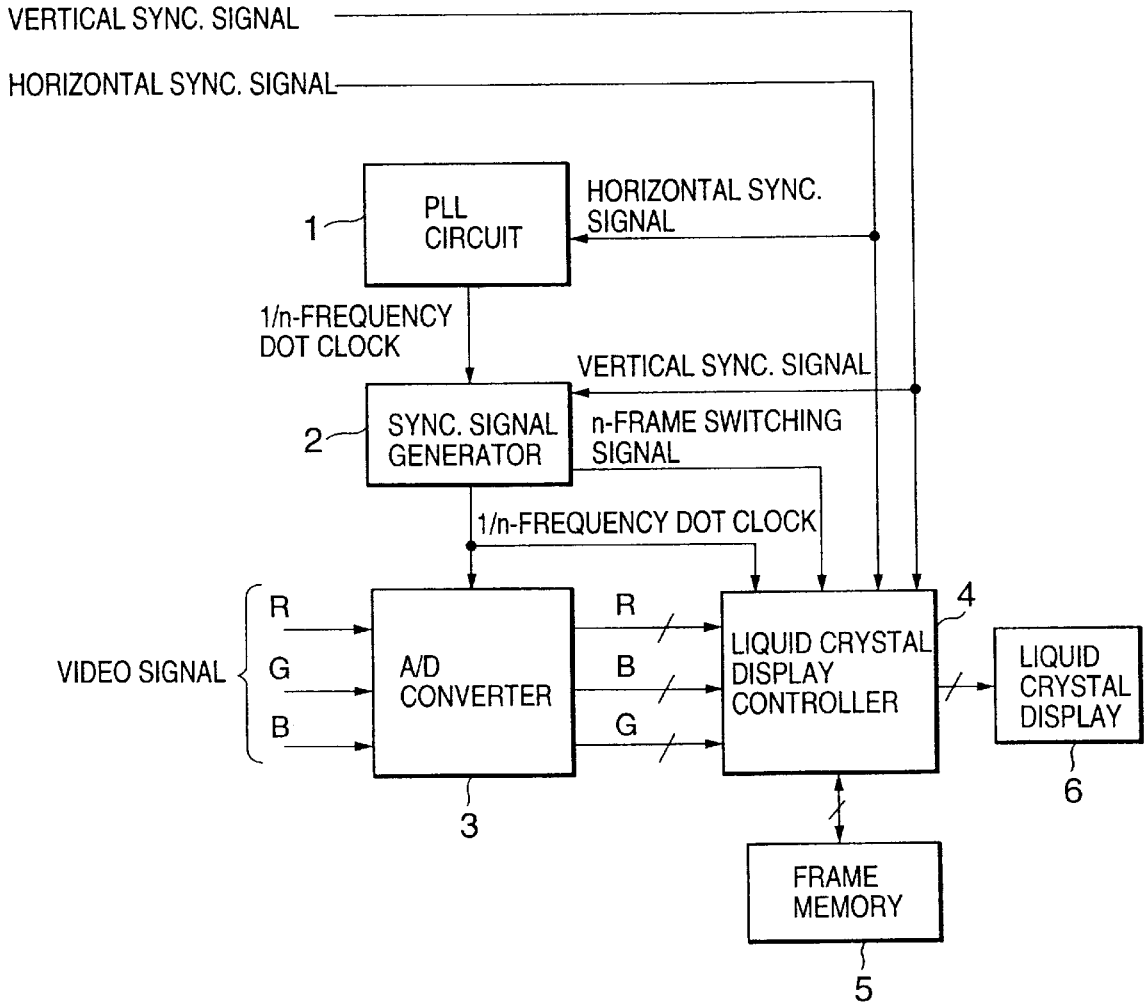
FIG. 17 is a diagram showing the construction of a liquid crystal display control device using a 1/n-frequency dot clock as a reference operating clock.
Figure 18:
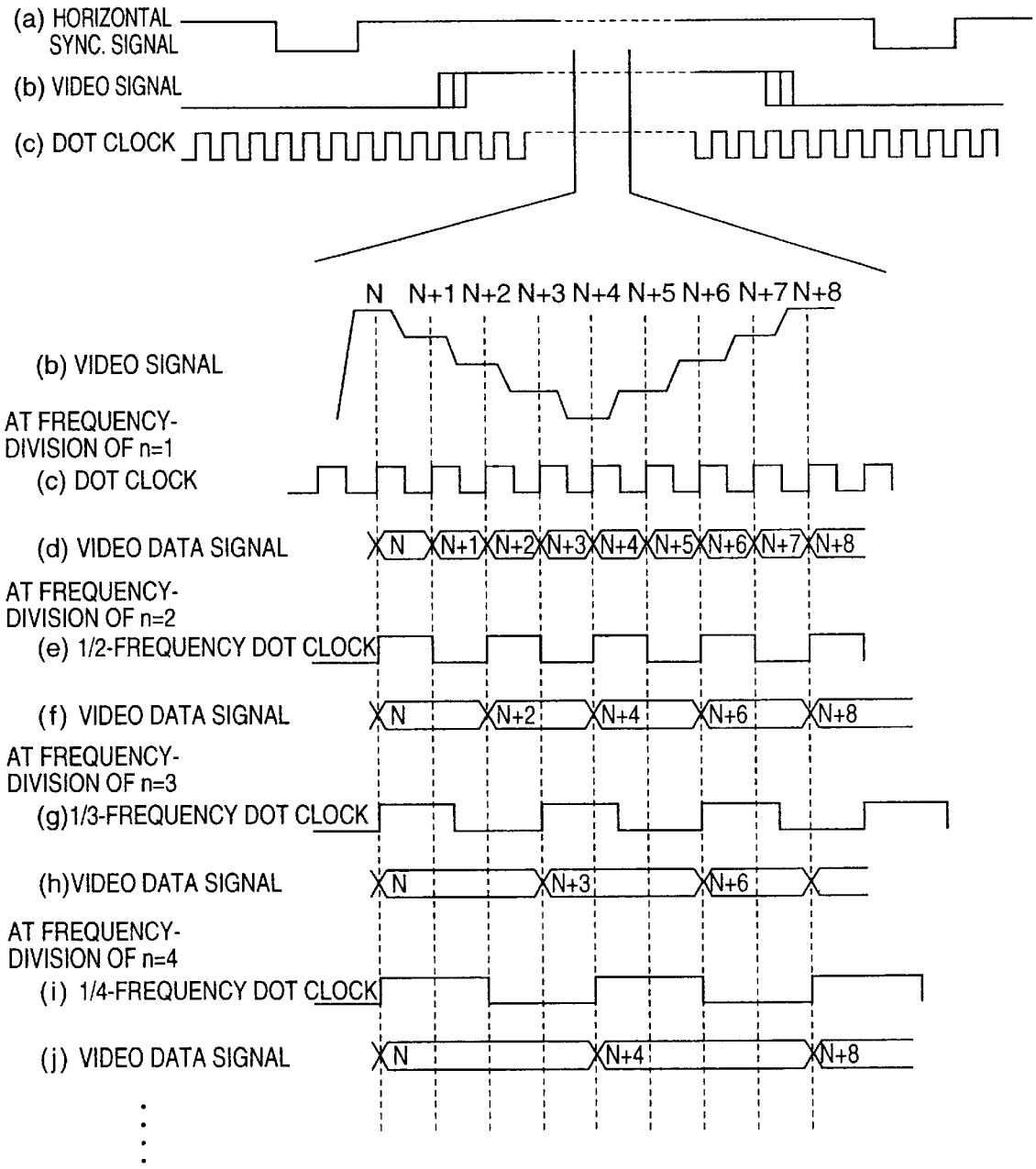
FIG. 18 is a diagram showing a data pickup timing.
Figure 19:
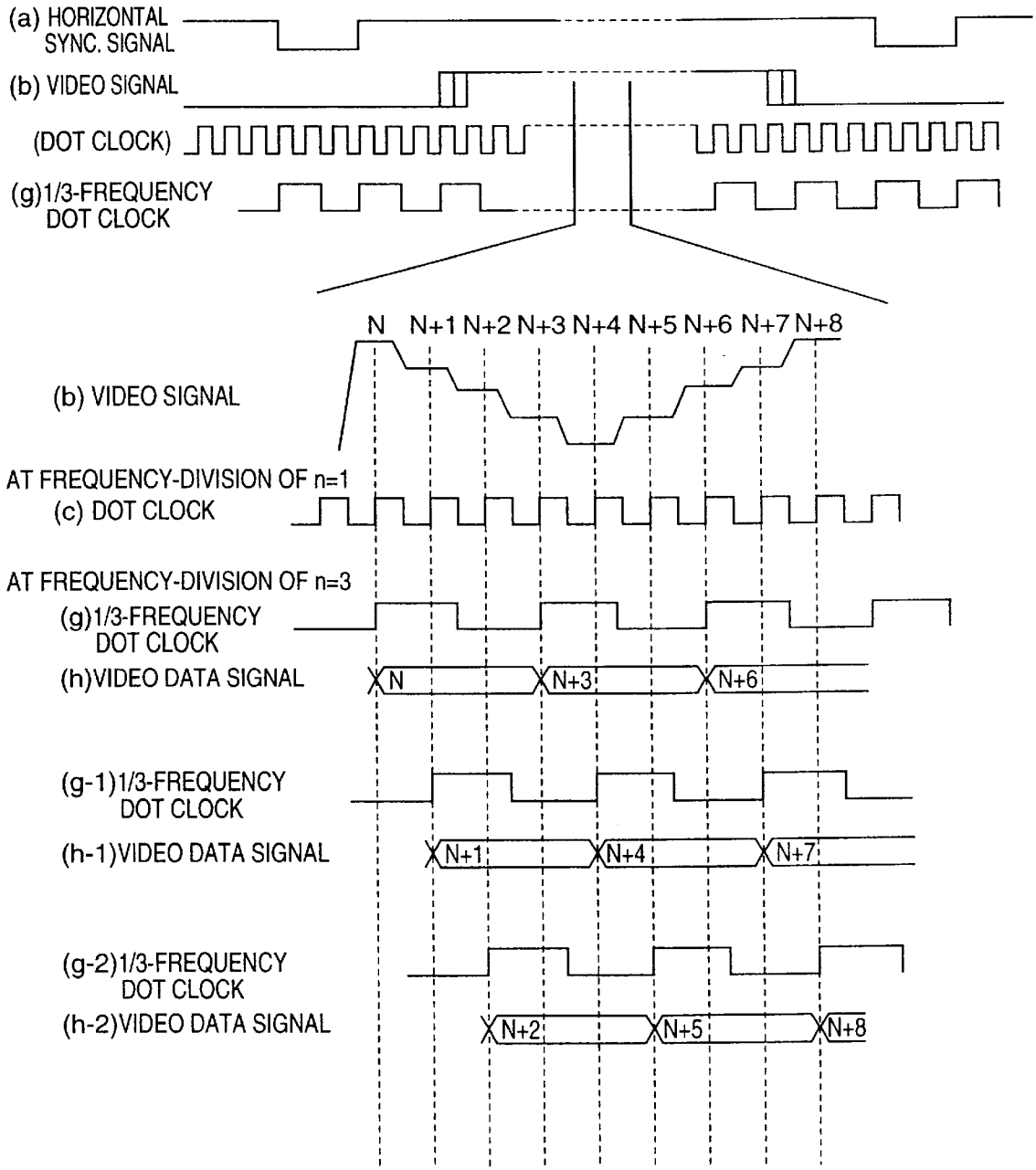
FIG. 19 is a diagram showing phase control of the 1/n-frequency dot clock in a case of n=3.

FIG. 17 shows the construction of the liquid crystal display control device which is supplied with analog data of video signals. The PLL circuit 1 generates a 1/n-frequency dot clock whose period is equal to n times the dot period of the input video signal. The 1/n-frequency dot clock is synchronized with the period of the input video signal, and the rise-up position thereof is set to the center of the dot period of the input video signal. As shown in FIG. 18, the data of the input video signal are picked up at an interval of (n−1) dots by the 1/n-frequency dot clock.

The synchronous signal generating circuit 2 generates an n-frame switching signal for identifying the n sequential input frame periods. The n-frame switching signal is a data signal which varies from '0'to n−1 one by one and repeats this variation every n input frame periods. In a case of n=2, the n-frame switching signal is the even-number/odd-number switching signal described above.

The synchronous signal generating circuit 3 controls the phase of the 1/n-frequency dot clock in accordance with the value of the n-frame switching signal. According to this phase control, the phase of the 1/n-frequency dot clock is shifted every 1-dot period in the sequential input frame periods by using a clock shift circuit (not shown). For example, setting an input frame period (g) as a reference, the phase in a case of n=3 is 1-dot period in a next input frame period (g−1), and 2-dot period in a further next input frame period (g−2), and this variation is repeated. In the continuous 3(=n) input frame periods, the display data of one frame are picked up.

The write address supplied to the frame memory 5 indicates a storage position of the frame memory 5 which corresponds to the display position of the pickup display data. In a case of n=3, the memory write address count value varies like '0', '3', '6', . . . in an input frame period, varies like '1', '4', '7', . . . in a next input frame period and varies like '2', '5', '8', . . . in a further next input frame period. Accordingly, in the continuous three input frame periods, the display data of one frame are stored in the frame memory 5.

The display data stored in the frame memory 5 are read out and displayed on the liquid crystal display unit 6 in synchronism with the output synchronous signal of a predetermined timing which is asynchronous with the input synchronous signal.

As described above, the present invention can be implemented for any n (n represents a natural number). In a case of n≧2, the speed of the reference operating clock of the liquid crystal display control device is reduced to be lower than that of the input video signal to perform the display control. The extended portion as described above may be easily applied to the construction of the third embodiment (FIG. 12) which supports the signal of the digital video signal.

Further, the present invention may be provided with functions to support plural different n values (for example, a set of n=1, 2, 3, a set of n=2,3, etc.), and one of these functions may be selectively made effective in accordance with the speed of the input video signal. The above second embodiment (FIG. 10) supports a set of n=1,2.

Figure 20:
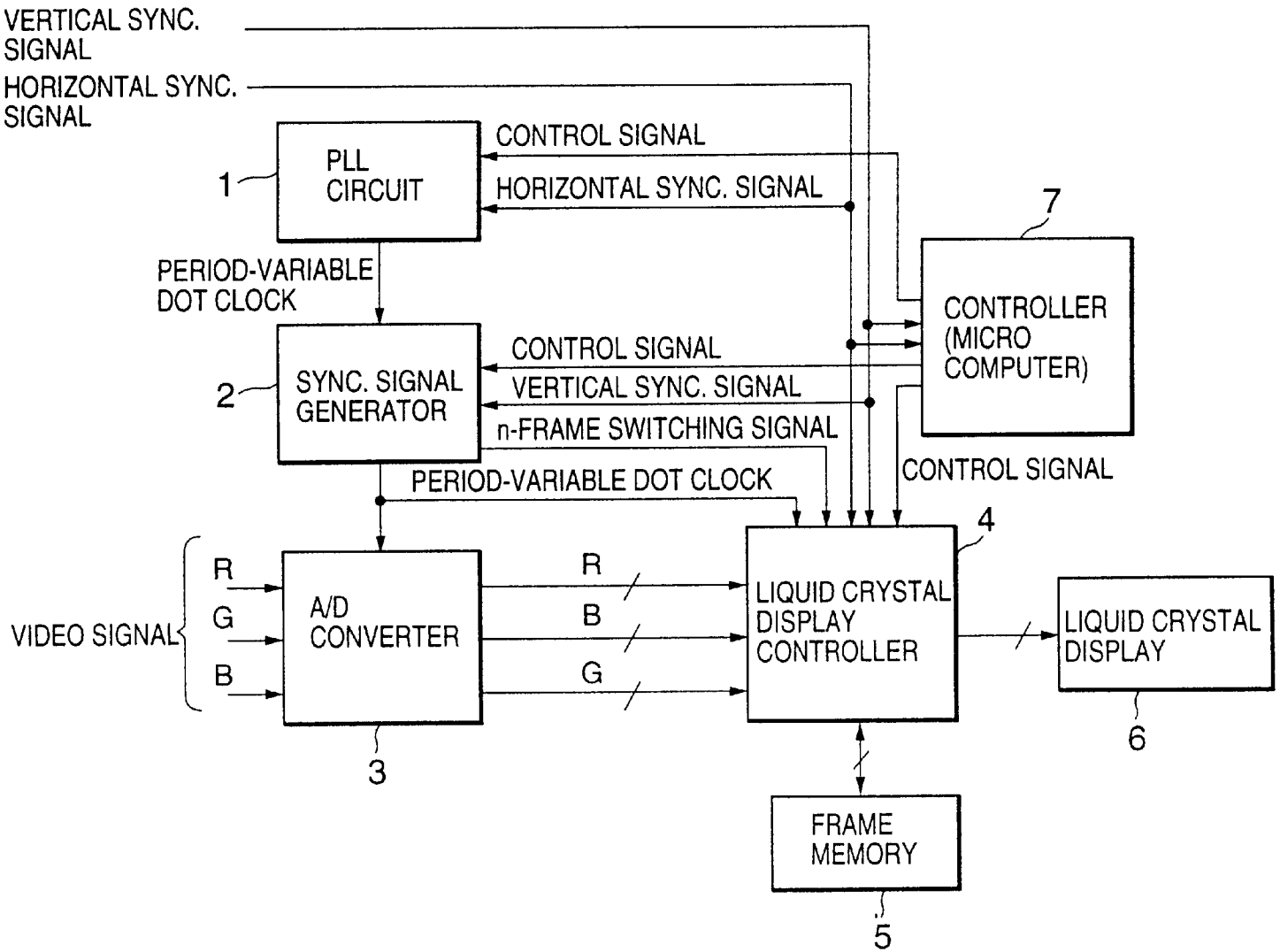
FIG. 20 is a diagram showing the construction of a liquid crystal display control device which selectively uses a 1/n-frequency dot clock (n takes plural different values) as a reference operating clock.

FIG. 20 shows the construction of a liquid crystal display control device which is designed to support plural n values. A function to support each n value can be implemented by the method as described with reference to FIGS. S17 to 19. Selective execution of each of these functions may be implemented by the method described in the second embodiment. The PLL circuit 1 is constructed to generate the corresponding period-variable dot clock in accordance with the control signal. The synchronous signal generating circuit 2 is constructed to perform the phase control of the period-variable dot clock and generate the frame switching signal.

Next, an information processing device including the above liquid crystal display control device will be described.

Figure 22:
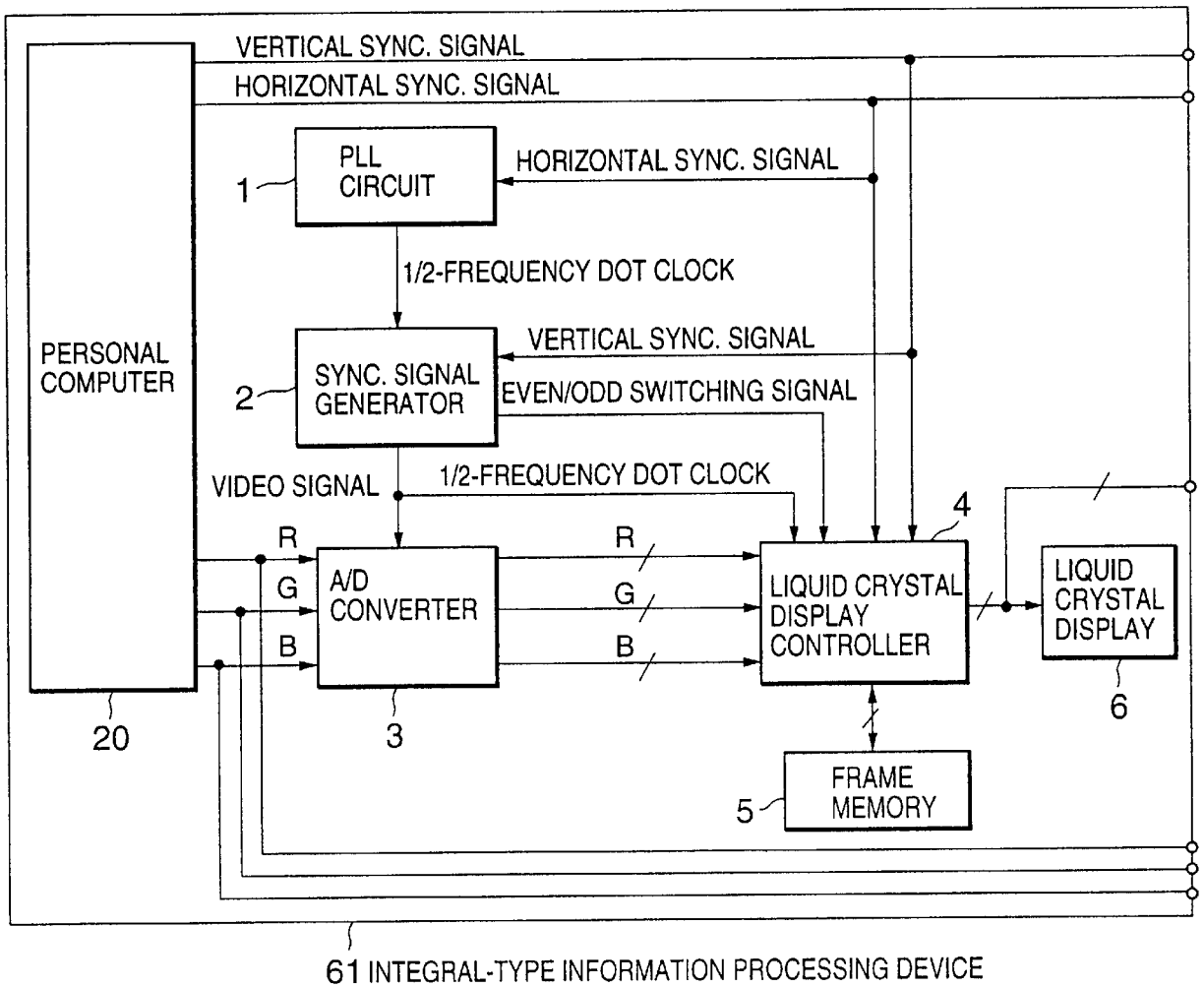
FIG. 22 is a first diagram showing the construction of an information processing device containing the liquid crystal display control device.
Figure 23:
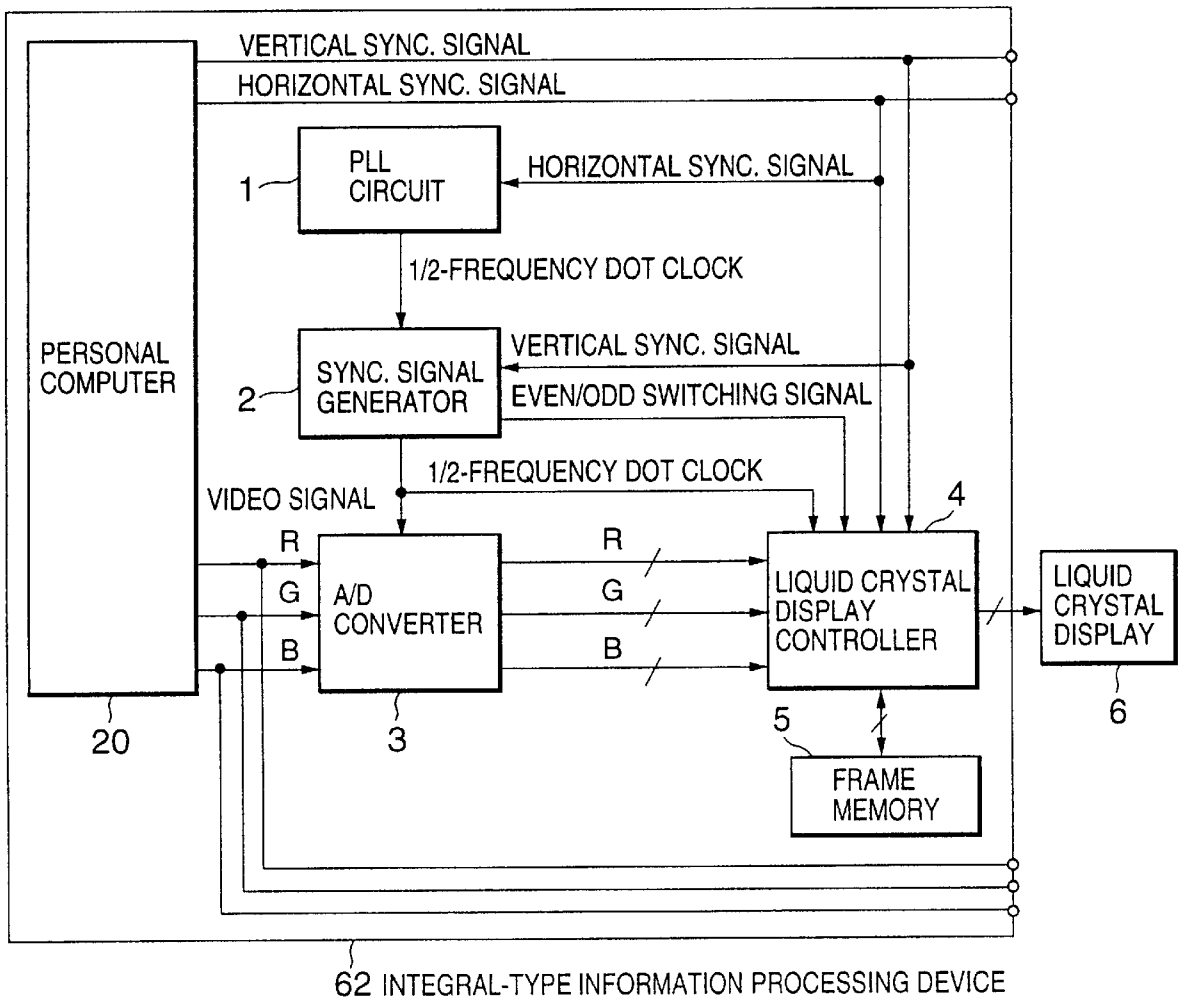
FIG. 23 is a second diagram showing the construction of an information processing device containing the liquid crystal display control device.

An information processing device 61 shown in FIG. 22 is implemented by unifying into one body the liquid crystal display device of the first embodiment (FIG. 1), the liquid display unit and a computer unit 20 serving as a functional part of a personal computer or a workstation. A conventional analog video output circuit may be used as a video output circuit of the computer unit 20. Further, by providing an analog video output terminal of the computer unit 20 and an output signal terminal of the liquid crystal display controller 4, it can be connected to an external liquid crystal display device or a CRT display device. As shown in FIG. 23, the liquid crystal display unit 6 may be disposed out of the information processing device.

Figure 24:
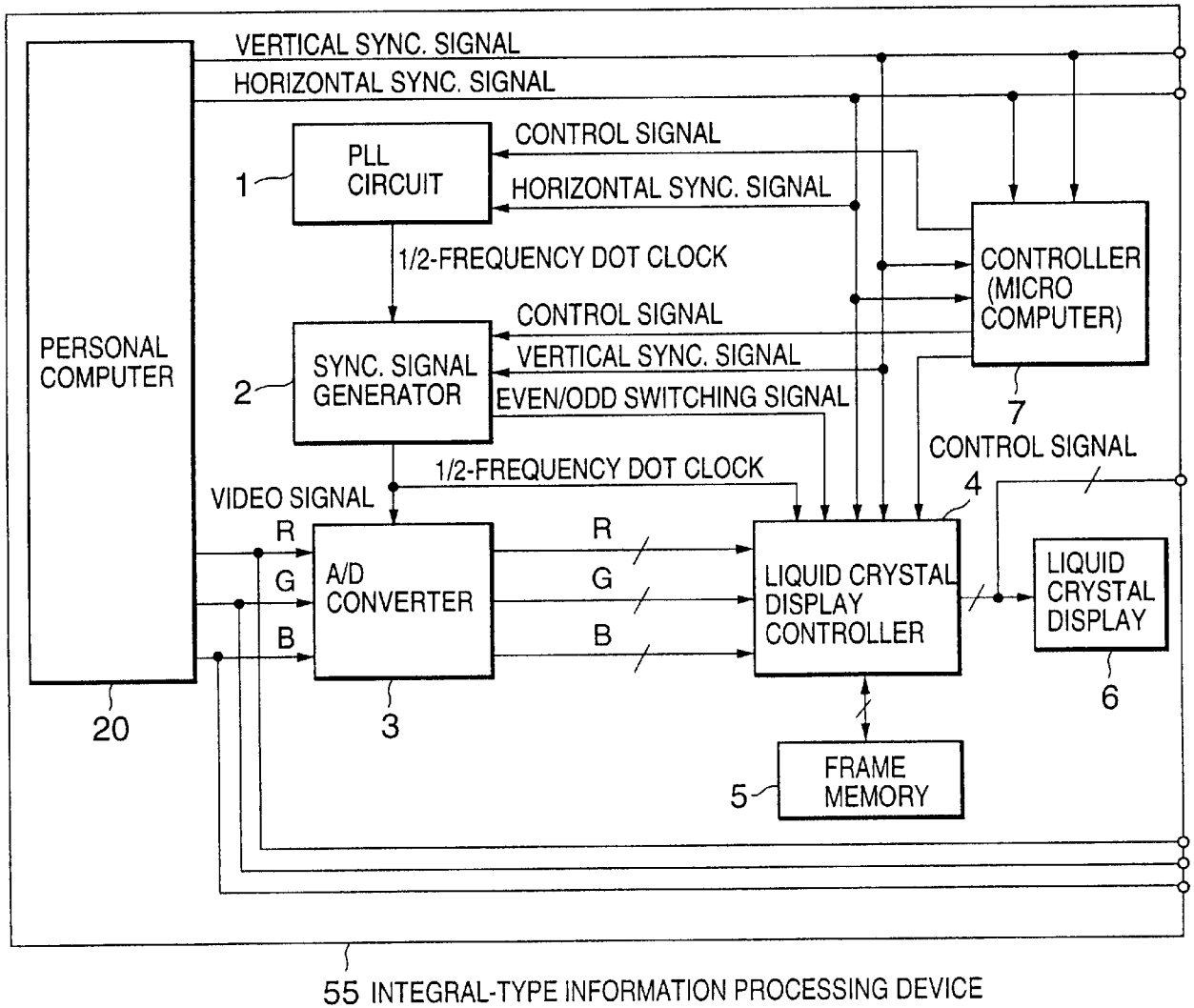
FIG. 24 is a third diagram showing the construction of an information processing device containing the liquid crystal display control device.
Figure 25:
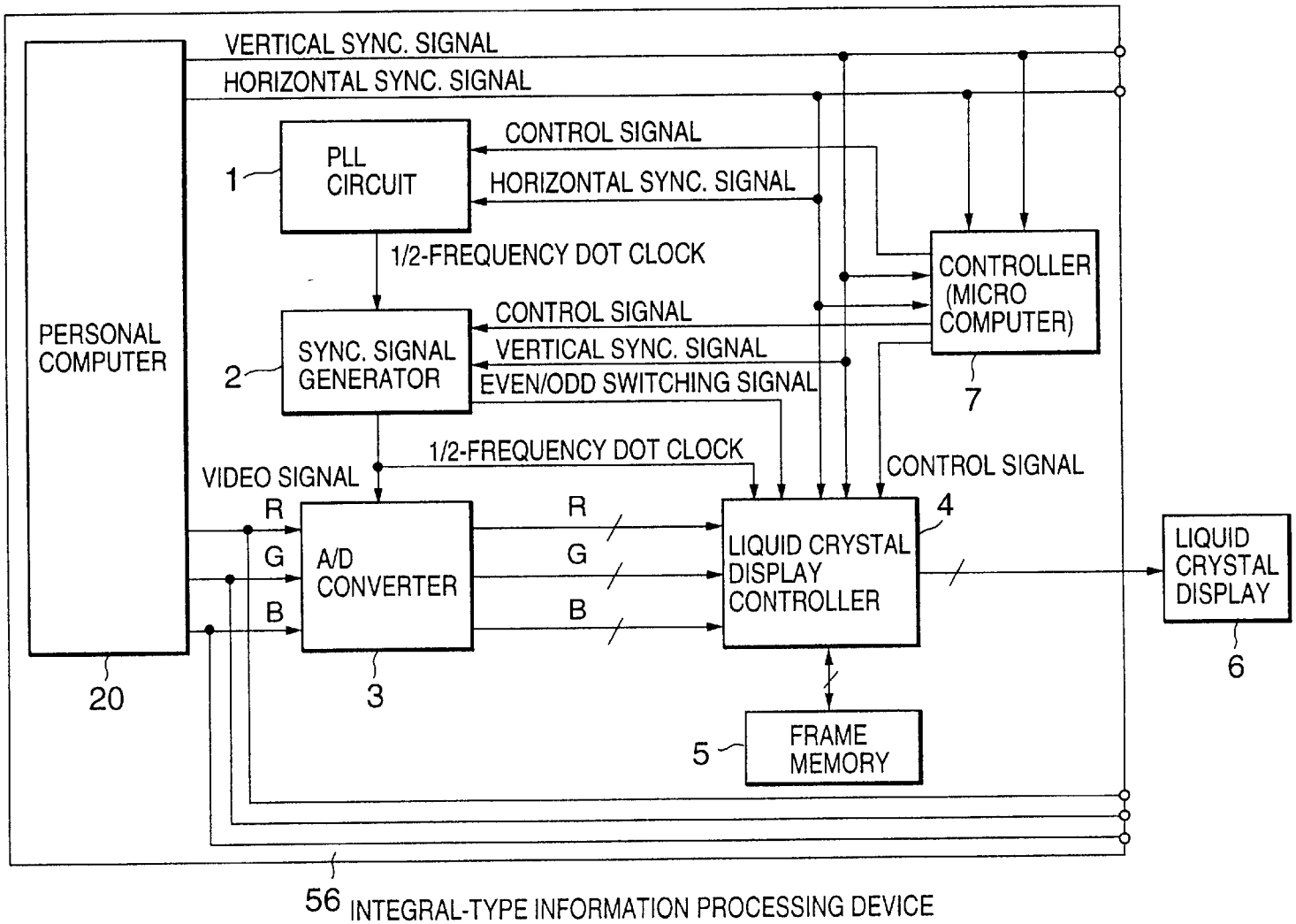
FIG. 25 is a fourth diagram showing the construction of an information processing device containing the liquid crystal display control device.
Figure 26:
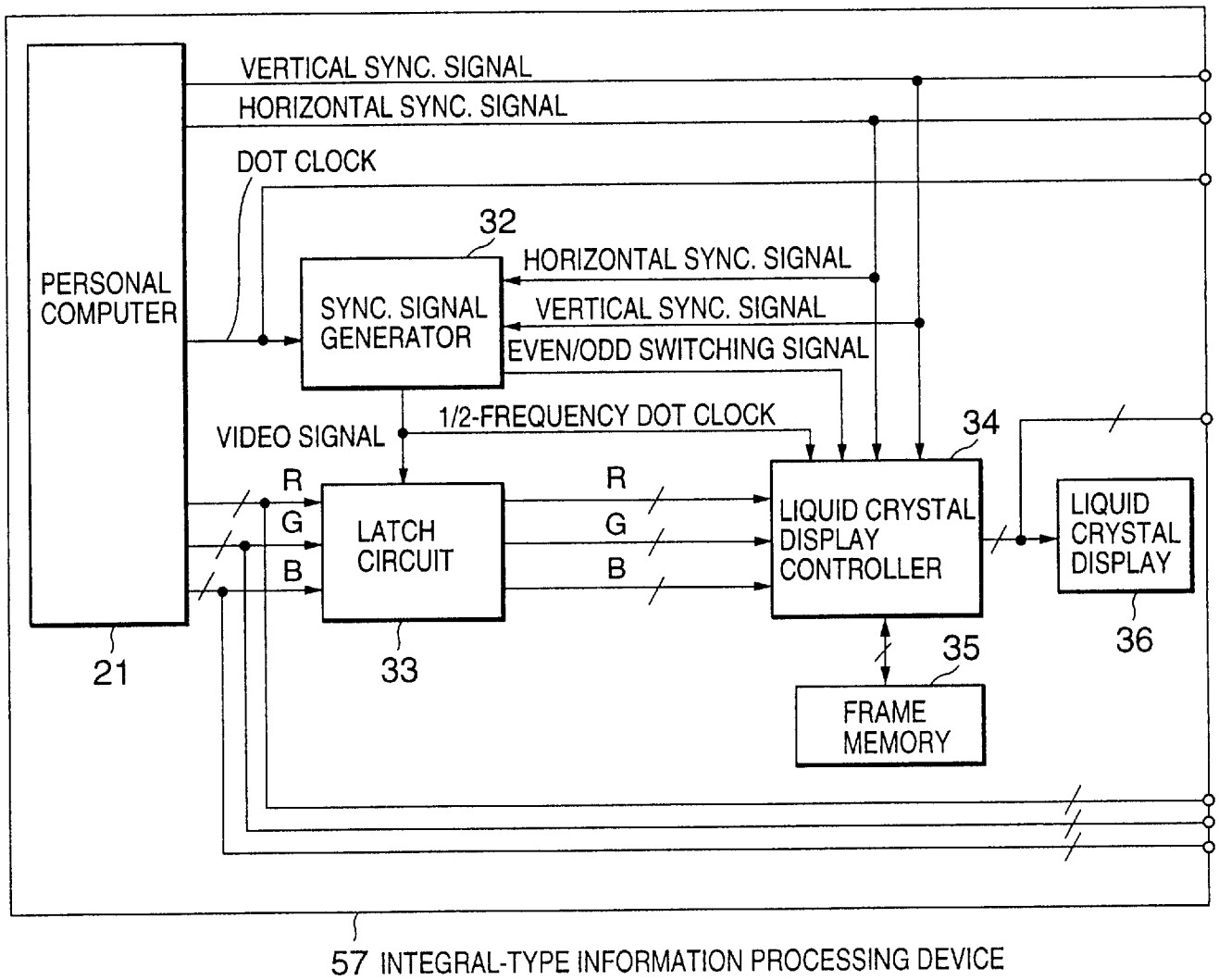
FIG. 26 is a fifth diagram showing the construction of an information processing device containing the liquid crystal display control device.
Figure 27:
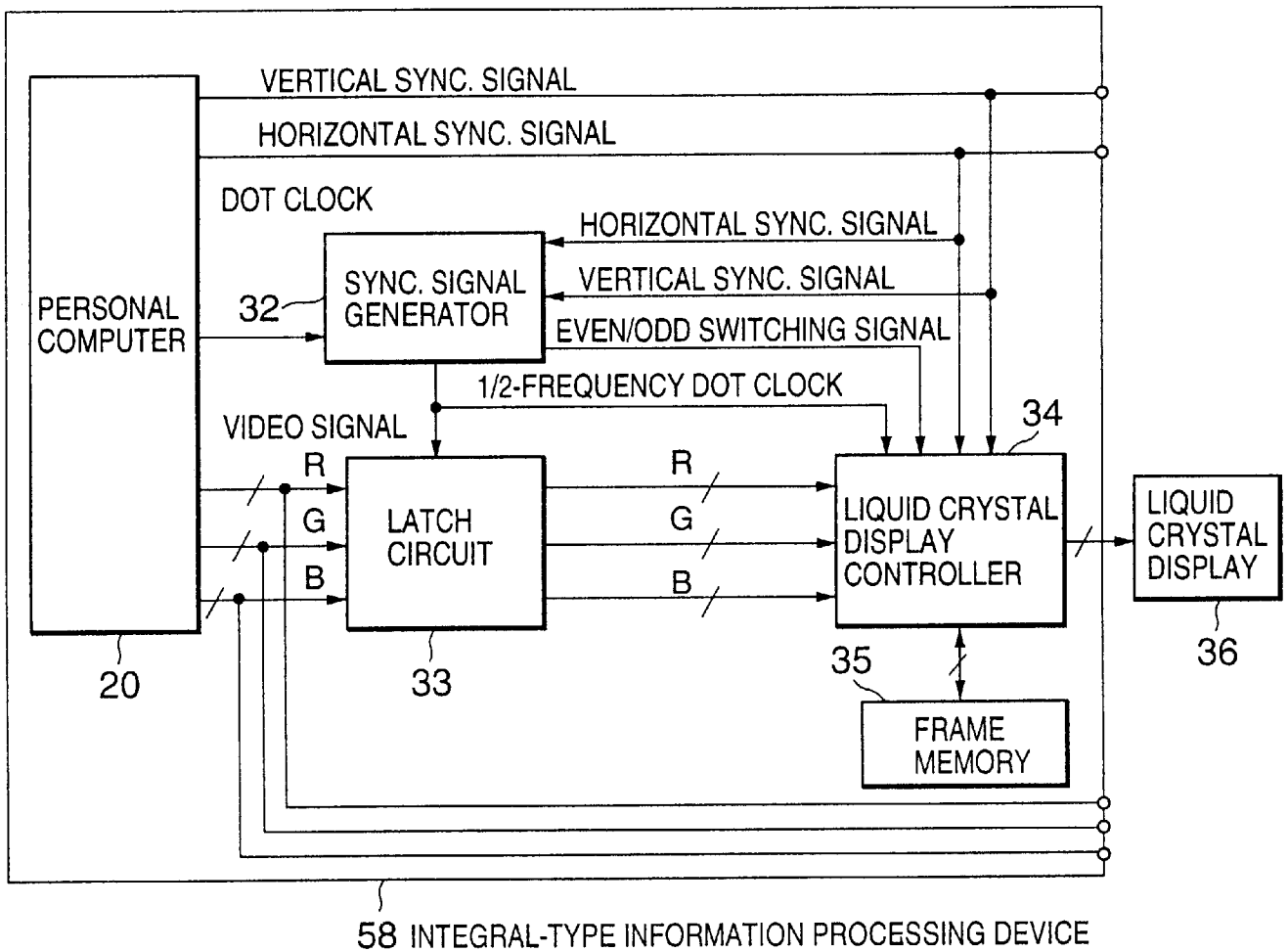
FIG. 27 is a sixth diagram showing the construction of an information processing device containing the liquid crystal display control device.
Figure 28:
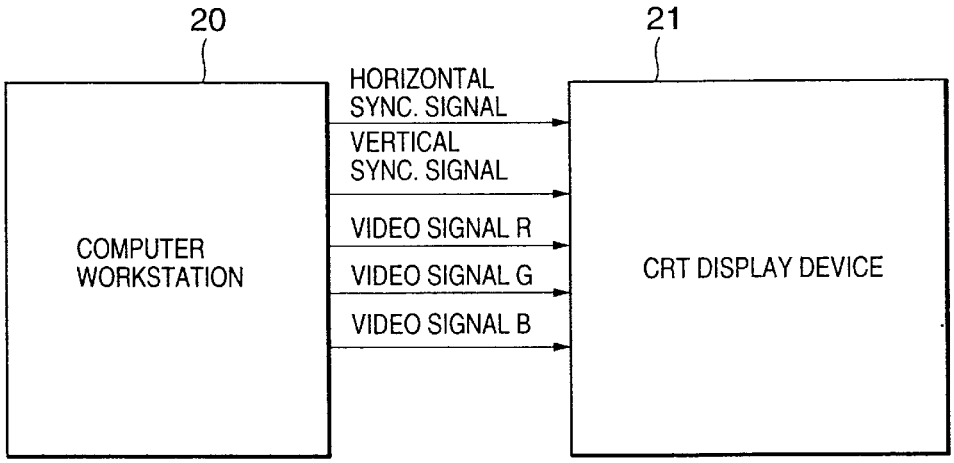
FIG. 28 PRIOR ART
FIG. 28 is a diagram showing a conventional connection between a CRT display device and a computer in the prior art.
Figure 29:
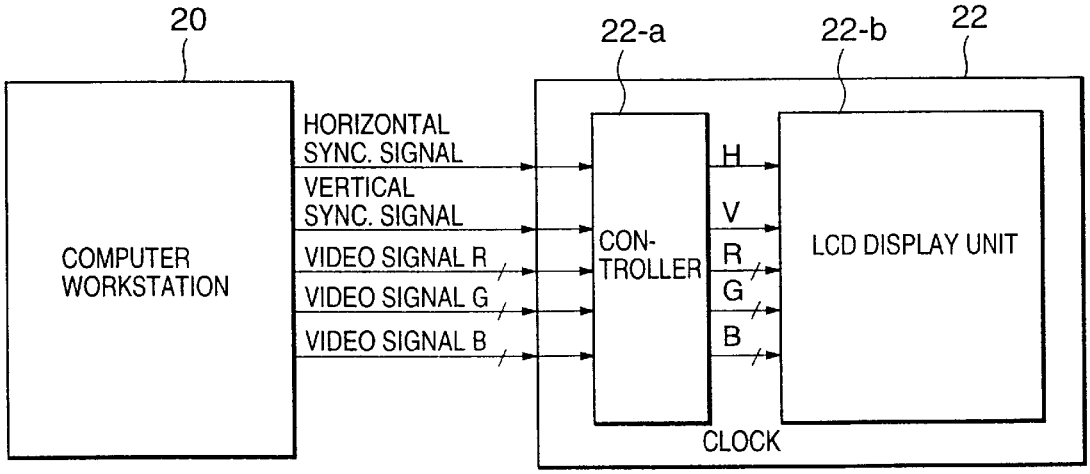
FIG. 29 PRIOR ART
FIG. 29 is a diagram showing a conventional connection between a liquid crystal display control device and a computer in the prior art.
Figure 30:
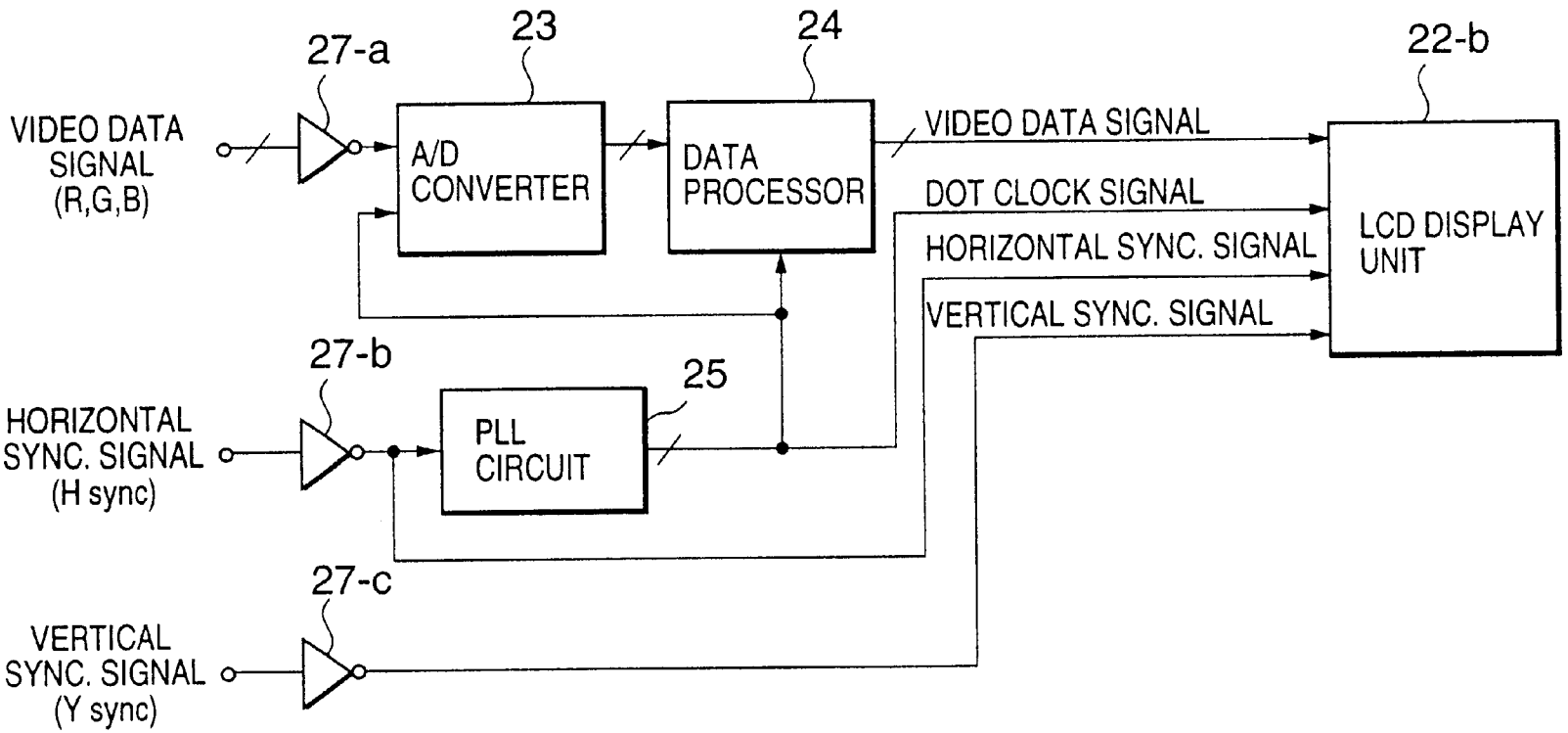
FIG. 30 PRIOR ART
FIG. 30 is a diagram showing the construction of a conventional liquid crystal display control device.

With respect to the liquid crystal display control device (FIG. 10) of the second embodiment, it may be integrally fabricated with the computer unit 20 as shown in FIGS. 24 and 25. The liquid crystal display control device of the third embodiment (FIG. 12) is suitably designed to be integrally fabricated with the computer 21 having a digital video output circuit serving as a video output circuit. It is needless to say that the liquid display control devices of the other embodiments may be integrally fabricated with a computer.

As described above, according to the present invention, there can be provided a liquid crystal display control device which can perform a series of operations from a pickup operation of video signals to a display operation of a liquid crystal panel at a lower speed while suppressing deterioration of image quality of display images.

What is claimed is

1. A display device for displaying a video signal, comprising:

a display unit for displaying said video signal;

a clock generation circuit for generating a 1/n-frequency dot clock signal having a period that is n times a dot period of said video signal;

a synchronous signal generation circuit for controlling a phase of said 1/n-frequency dot clock signal in accordance with a frame period of said video signal;

a memory for storing said video signal; and a control circuit for writing said video signal into said memory in accordance with said 1/n-frequency dot clock signal and for reading said video signal from said memory in accordance with an output synchronous signal that is different from said 1/n-frequency dot clock signal to output the video signal to said display unit.

2. A display device according to claim 1, wherein said synchronous signal generation circuit inverts the phase of said 1/n-frequency dot clock signal for every frame period.

3. A display device according to claim 2, wherein said synchronous signal generation circuit generates a switching signal that is synchronized with said frame period and having a logical level which inverts for every period, and which inverts the phase of said 1/n-frequency dot clock signal in accordance with said switching signal which is generated.

4. A display device according to claim 2, said display unit further comprising:

a display panel on which pixels are arranged in a matrix form;

a data driver circuit for capturing said video signal outputted from said display control circuit and for applying a gradation voltage corresponding to said video data which is captured to said display panel; and a scan driver circuit for selecting a line of said display panel to which said gradation voltage is to be applied in accordance with said output synchronous signal.

5. A display device according to claim 1, wherein said control circuit writes display data contained in said video data to the memory with a predetermined interval and reads said display data subsequently from a head side of a storing position to an end side of the storing position of the memory.

6. A display device according to claim 1, wherein said control circuit generates said output synchronous signal.

7. A display device according to claim 1, wherein n is an integer 2.

8. A display device according to claim 1, wherein said pixels include liquid crystal pixels.

9. A display device for displaying a video signal, comprising:

a display unit for displaying said video signal;

a clock generation circuit for generating a 1/n-frequency dot clock signal having a period that is n times a horizontal synchronous signal of said video signal;

a synchronous signal generation circuit for inverting a logical level of said 1/n-frequency dot clock signal in accordance with a vertical synchronous signal of said video signal;

a memory for storing said video signal; and a control circuit for writing said video signal into said memory in accordance with said 1/n-frequency dot clock signal and for reading said video signal from said memory in accordance with an output synchronous signal that is different from said 1/n-frequency dot clock signal to output the video signal to said display unit.

10. A display device according to claim 9, wherein said synchronous signal generation circuit generates a switching signal that is synchronized with said vertical synchronous signal and having a logical level which inverts for every period, and which inverts the phase of said 1/n-frequency dot clock signal in accordance with said switching signal which is generated.

11. A display device for displaying a video signal comprising:

a display unit for displaying said video signal;

a synchronous signal generation circuit for generating a 1/n-frequency dot clock signal by dividing frequency of a dot clock externally inputted by n, and for controlling a phase of said 1/n-frequency dot clock signal in accordance with a frame period of said video signal;

a memory for storing said video signal; and a control circuit for writing said video signal into said memory in accordance with said 1/n-frequency dot clock signal and for reading said video signal from said memory in accordance with an output synchronous signal that is different from said 1/n-frequency dot clock signal to output the video signal to said display unit.

12. A display device according to claim 11, wherein said synchronous signal generation circuit inverts the phase of said 1/n-frequency dot clock signal for every frame period.

13. A display device according to claim 12, wherein said synchronous signal generation circuit generates a switching signal that is synchronized with said frame period and having a logical level which inverts for every period, and which inverts the phase of said 1/n-frequency dot clock signal in accordance with said switching signal which is generated.

14. A display device for displaying a video signal comprising:

a display unit for displaying said video signal;

a synchronous signal generation circuit for generating 1/n-frequency dot clock signal by dividing frequency of a dot clock externally inputted by n, and for inverting a phase of said 1/n-frequency dot clock signal in accordance with a vertical synchronous signal of said video signal;

a memory for storing said video signal; and a control circuit for writing said video signal into said memory in accordance with said 1/n-frequency dot clock signal and for reading said video signal from said memory in accordance with an output synchronous signal that is different from said 1/n-frequency dot clock signal to output the video signal to said display unit.

15. A display device according to claim 14, wherein said synchronous signal generation circuit generates a switching signal that is synchronized with said vertical synchronous signal and having a logical level which inverts for every period, and which inverts said 1/n-frequency dot clock signal in accordance with said switching signal which is generated.

* * * * *